US006928252B2

(12) United States Patent
Takami et al.

(10) Patent No.: US 6,928,252 B2
(45) Date of Patent: Aug. 9, 2005

(54) PROCESS UNIT AND IMAGE FORMING APPARATUS HAVING A STRUCTURE TO REMOVE FOREIGN MATTER

(75) Inventors: Takeshi Takami, Nagoya (JP); Makoto Ishii, Nagoya (JP); Kazushi Fukuta, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/394,197

(22) Filed: Mar. 24, 2003

(65) Prior Publication Data

US 2003/0185588 A1 Oct. 2, 2003

(30) Foreign Application Priority Data

Mar. 29, 2002 (JP) ..... 2002-096223
Mar. 29, 2002 (JP) ..... 2002-096224

(51) Int. Cl.[7] ..... G03G 21/00; G03G 21/18
(52) U.S. Cl. ..... 399/111; 399/357
(58) Field of Search ..... 399/102, 111, 399/123, 357, 358, 360

(56) References Cited

U.S. PATENT DOCUMENTS

| | | | | |
|---|---|---|---|---|
| 3,884,572 A | * | 5/1975 | Bacon et al. | 399/357 |
| 4,530,596 A | * | 7/1985 | Kawamoto et al. | 399/357 |
| 4,540,268 A | * | 9/1985 | Toyono et al. | 399/111 |
| 4,618,250 A | * | 10/1986 | Noguchi et al. | 399/357 |
| 4,819,026 A | | 4/1989 | Lange et al. | |
| 4,967,231 A | | 10/1990 | Hosoya et al. | |
| 5,294,968 A | | 3/1994 | Ueda et al. | |
| 5,323,213 A | * | 6/1994 | Ahn | 399/357 |
| 5,432,590 A | | 7/1995 | Nomura et al. | |
| 5,503,421 A | | 4/1996 | DeLisser et al. | |
| 5,530,537 A | | 6/1996 | Thayer | |
| 5,740,494 A | | 4/1998 | Shoji et al. | |
| 5,740,499 A | | 4/1998 | Higeta et al. | |
| 5,884,124 A | | 3/1999 | Karakama et al. | |
| 5,999,791 A | | 12/1999 | Ogawa et al. | |
| 6,078,763 A | | 6/2000 | Hoshi | |
| 6,298,217 B1 | * | 10/2001 | Murayama et al. | 399/358 |
| 2003/0039495 A1 | | 2/2003 | Takami et al. | 399/357 |
| 2003/0049046 A1 | | 3/2003 | Okabe | 399/111 |

FOREIGN PATENT DOCUMENTS

| | | |
|---|---|---|
| JP | A-61-39080 | 2/1986 |
| JP | U-63-88878 | 6/1988 |
| JP | A-1-195485 | 8/1989 |
| JP | U-2-1763 | 1/1990 |
| JP | A-2-40683 | 2/1990 |
| JP | A-3-55565 | 3/1991 |
| JP | A-4-26864 | 1/1992 |
| JP | A-5-2357 | 1/1993 |
| JP | A-5-19546 | 1/1993 |
| JP | A-5-19646 | 1/1993 |
| JP | A-5-61396 | 3/1993 |
| JP | A-5-232828 | 9/1993 |
| JP | A-6-19379 | 1/1994 |
| JP | A-6-195006 | 7/1994 |
| JP | A-6-324594 | 11/1994 |
| JP | A-7-77846 | 3/1995 |
| JP | A-8-69242 | 3/1996 |

(Continued)

*Primary Examiner*—William J. Royer
(74) *Attorney, Agent, or Firm*—Oliff & Berridge, PLC

(57) ABSTRACT

A process unit and an image forming apparatus including an image holding member that holds an image thereon, a first cleaning roller that contacts a surface of the image holding member, a second cleaning roller that contacts a surface of the first cleaning roller, and a bearing member that integrally forms a first bearing and a second bearing on a base element, the first bearing supporting the first cleaning roller rotatably and the second bearing supporting the second cleaning roller rotatably.

60 Claims, 17 Drawing Sheets

FOREIGN PATENT DOCUMENTS

| | | |
|---|---|---|
| JP | A-8-83035 | 3/1996 |
| JP | A-8-272228 | 10/1996 |
| JP | A 9-127844 | 5/1997 |
| JP | A-9-138574 | 5/1997 |
| JP | A-9-138624 | 5/1997 |
| JP | A 9-292809 | 11/1997 |
| JP | A 9-319278 | 12/1997 |
| JP | A 10-39705 | 2/1998 |
| JP | A-10-49016 | 2/1998 |
| JP | A-10-105026 | 4/1998 |
| JP | A-10-133541 | 5/1998 |
| JP | A-11-73080 | 3/1999 |

* cited by examiner

PROCESS UNIT AND IMAGE FORMING APPARATUS HAVING A STRUCTURE TO REMOVE FOREIGN MATTER

BACKGROUND OF THE INVENTION

1. Field of Invention

The invention relates to a process unit and an image forming apparatus having a structure to remove foreign matter, such as paper dust, carried on a photosensitive member.

2. Description of Related Art

An electrophotographic image forming apparatus, such as a laser printer, is provided with a process unit that has a photosensitive drum, a charger, a scanner, a developing roller, and a transfer roller. The surface of the photosensitive drum is first uniformly charged by the charger along with the rotation of the photosensitive drum. Thereafter, the photosensitive drum is then irradiated with a laser beam emitted from the scanner and an electrostatic latent image is formed based on predetermined image data.

In the process unit, toner is stored in a toner hopper, supplied from the toner hopper to the developing roller, and carried in a thin layer on the developing roller. When the developing roller rotates and is in contact with the photosensitive drum, toner carried on the developing roller is selectively supplied onto the latent image formed on the photosensitive drum, and the latent image is transformed into a visible image. When a sheet is passing between the photosensitive drum and the transfer roller, the visible image carried on the surface of the photosensitive drum is transferred to the sheet.

In such an image forming apparatus, a cleaner-less developing method is known, in which toner remaining on the photosensitive drum after the toner has been transferred to the sheet is collected by the developing roller. For the cleaner-less developing method, if an abundance of toner remains on the photosensitive drum after transfer, the remaining toner may not be completely collected by the developing roller. Such toner may exert influence on the next visible image formed on the photosensitive drum, so that a ghost image may appear on the image.

Japanese Laid-Open Patent Publication No. HEI 9-127844 discloses a technique where an electrically conductive cleaning roller is provided so as to make contact with a photosensitive drum. When toner is transferred to a sheet, a bias is applied to the cleaning roller to move the toner remaining on the photosensitive drum to the cleaning roller, so that the toner remaining on the photosensitive drum is temporarily caught by the cleaning roller. When toner is not transferred to a sheet, that is, during a time equal to a time interval from the end of printing of a page to the start of printing of the next page, a bias is applied to the cleaning roller so as to move the toner caught by the cleaning roller to the photosensitive drum, so that the toner is returned to the photosensitive drum. The returned toner is collected by a developing roller.

However, with this cleaner-less developing method, paper dust moving from a sheet to the photosensitive drum during transfer is also caught by the cleaning roller. In Japanese Laid-Open Patent Publication No. HEI 9-127844, an electrically conductive brush that makes sliding contact with the cleaning roller is provided. When a bias with the same polarity as toner is applied to the brush, the brush catches paper dust only on the cleaning roller. However, it is difficult to cause the tip of the brush to make contact with the circumferential surface of the cleaning roller uniformly because the brush density is course. As a result, paper dust is not removed uniformly, and there is a limit in improving the ability to remove paper dust.

SUMMARY OF THE INVENTION

The invention is directed to a process unit and image forming apparatus having a structure to remove foreign matter, such as paper dust, carried on a photosensitive member. The process unit according to a first exemplary aspect includes an image holding member that holds an image thereon, a first cleaning roller that contacts a surface of the image holding member, a second cleaning roller that contacts a surface of the first cleaning roller and a bearing member that integrally forms a first bearing and a second bearing on a base element, the first bearing supporting the first cleaning roller rotatably and the second bearing supporting the second cleaning roller rotatably.

The process unit according to a second exemplary aspect includes a housing, an image holding member provided at the housing, a first cleaning roller that contacts a surface of the image holding member, and a second cleaning roller that contacts a surface of the first cleaning roller, wherein the housing is formed with an upper frame and a lower frame joined with the upper frame, and the first cleaning roller and the second cleaning roller are positioned when the upper frame and the lower frame are joined.

The process unit according to a third exemplary embodiment includes a housing, an image holding member provided at the housing, a cleaning roller that contacts a surface of the image holding member, and a first bearing member and a second bearing member each supported by the housing, the first bearing member supporting a first end of the cleaning roller rotatably, and the second bearing member supporting a second end of the cleaning roller rotatably, wherein the first bearing member is positioned by the housing in one direction and the second bearing member is positioned by the housing in an opposite direction to the one direction.

The process unit according to a fourth exemplary aspect includes an image holding member that holds an image thereon, the image holding member having an end with a first helical gear, and a cleaning roller that contacts a surface of the image holding member, the cleaning roller having an end with a second helical gear that engages the first helical gear.

The process unit according to a fifth exemplary aspect includes an image holding member that holds an image thereon, a first cleaning roller that contacts a surface of the image holding member and that captures foreign matter on the image holding member, a second cleaning roller that contacts a surface of the first cleaning roller and that captures the foreign matter on the first cleaning roller, a scraper that removes the foreign matter from the second cleaning roller, and a container that holds the foreign matter removed from the second cleaning roller.

The process unit according to a sixth exemplary aspect includes an image holding member that holds an image thereon, a cleaning roller that contacts a surface of the image holding member and captures foreign matter on the image holding member, a scraper that removes the foreign matter from the cleaning roller, and a container that holds the foreign matter removed from the cleaning roller, the container being formed with a bottom wall and a plurality of projection walls projecting from the bottom wall, wherein the plurality of projection walls forms a plurality of storage chambers and a common space above the plurality of the storage chambers.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
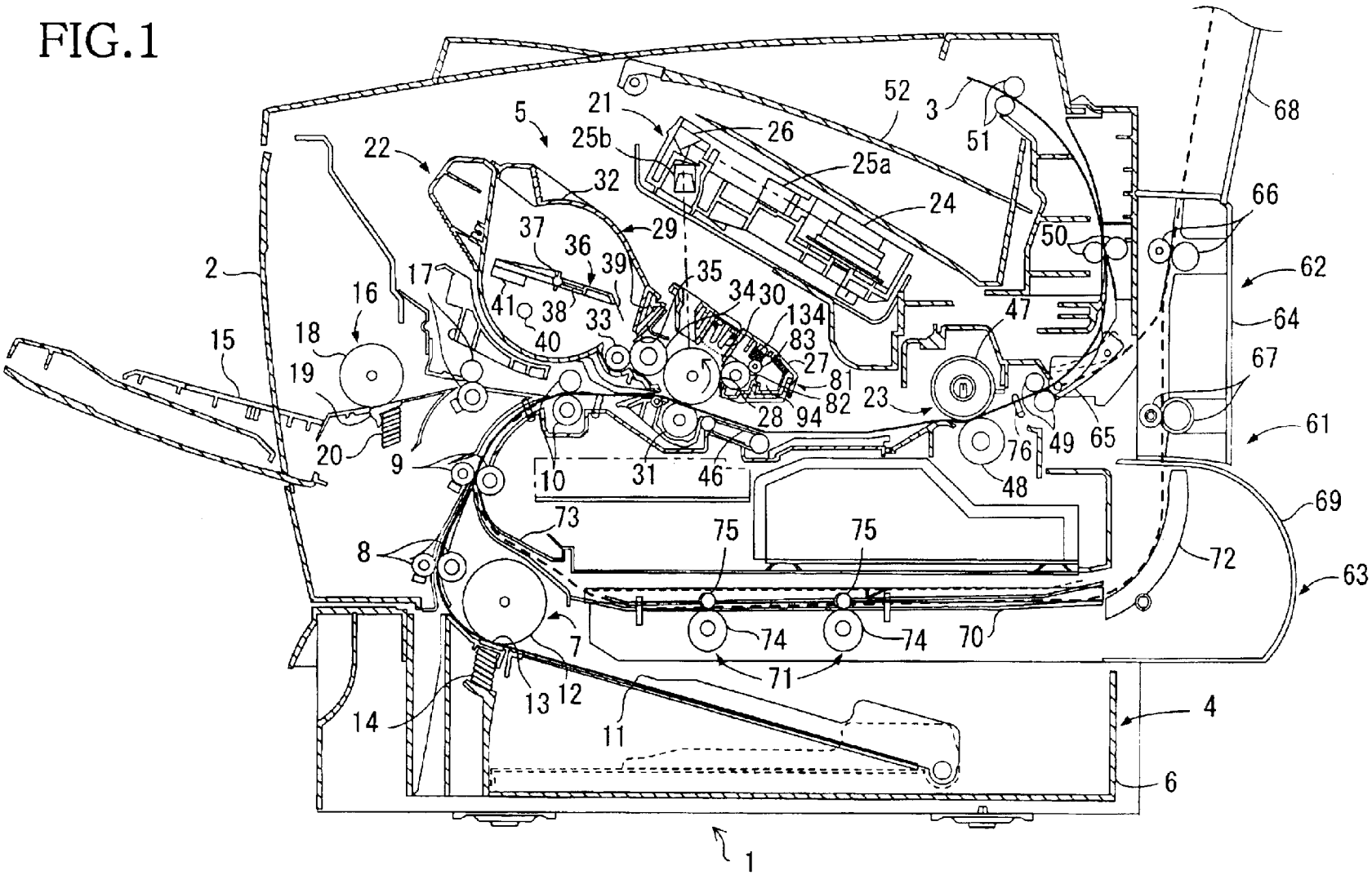
FIG. 1 is a side sectional view of principal parts of a laser printer.

An embodiment of the invention will be described in detail with reference to the accompanying drawings. A laser printer 1 is an electrophotographic laser printer that forms an image using a non-magnetic one-component developing system. As shown in FIG. 1, the laser printer 1 is provided with a casing that includes a feeder unit 4 that supplies a sheet 3 and an image forming unit 5 that forms an image on the sheet 3.

The feeder unit 4 includes a sheet feed tray 6 detachably attached to a bottom portion of a casing 2, a paper feed mechanism 7 provided at one end of the sheet feed tray 6, conveying rollers 8, 9 provided downstream from the paper feed mechanism 7 with respect to a sheet conveying direction, and resist rollers 10 provided downstream from the conveying rollers 8, 9 with respect to the sheet conveying direction.

The sheet feed tray 6 has an open-top box shaped structure to accommodate a stack of sheets 3, and is detachable from the casing 2 in a horizontal direction with respect to the bottom portion of the casing 2. A presser plate 11 is provided in the sheet feed tray 6. The presser plate 11 allows the sheets 3 to be stacked thereon. The presser plate 11 is pivotally supported at its end remote from the paper feed mechanism 7 such that the presser plate 11 is vertically movable at its end closest to the paper feed mechanism 7. The presser plate 11 is urged upwardly from its reverse, or bottom, side by a spring (not shown). When the stack of sheets 3 increases in quantity, the presser plate 11 swings downwardly about its end remote from the paper feed mechanism 7, against the urging force of the spring. The paper feed mechanism 7 includes a sheet feed roller 12, a separation pad 13 facing the sheet feed roller 12, and a spring 14 disposed on the reverse side of the separation pad 13. The separation pad 13 is urged toward the sheet feed roller 12 by the urging force of the spring 14.

When the presser plate 11 is urged upwardly by the spring, an uppermost sheet 3 of the stack on the presser plate 11 is moved toward the sheet feed roller 12. When the sheet feed roller 12 rotates, the leading edge of the sheet 3 is pinched between the sheet feed roller 12 and the separation pad 13, and the sheet 3 is separated from the stack. Thus, the sheets 3 are fed one by one from the top of the stack. The separated sheet 3 is fed to the resist rollers 10 via the conveying rollers 8, 9. The resist rollers 10 are a pair of rollers designed to feed the sheet 3 to an image forming position (a contact between a photosensitive drum 28 and a transfer roller 31 described later) while correcting its orientation.

The feeder unit 4 of the laser printer 1 includes a multi-purpose tray 15 on which arbitrary sized sheets 3 are loaded, a multi-purpose paper feed mechanism 16 that supplies the sheets on the multi-purpose tray 15, and multi-purpose conveying rollers 17. The multi-purpose tray 15 is designed to allow arbitrary sized sheets 3 to be stacked thereon. The multi-purpose paper feed mechanism 16 includes a multi-purpose sheet feed roller 18, a multi-purpose separation pad 19 facing the multi-purpose sheet feed roller 18, and a spring 20 disposed on the reverse side of the separation pad 19. The multi-purpose separation pad 19 is urged toward the multi-purpose sheet feed roller 18 by the urging force of the spring 20.

An uppermost sheet 3 of the stack loaded on the multi-purpose tray 15 is pinched between the multi-purpose sheet feed roller 18 and the multi-purpose separation pad 19 when the multi-purpose sheet feed roller 18 rotates, and thereafter separated from the stack. Thus, the sheets 3 are fed one by one from the top of the stack. A sheet 3 separated from the stack is fed to the resist rollers 10 by the multi-purpose conveying rollers 17.

The image forming unit 5 includes a scanner unit 21, a process unit 22, and a fixing unit 23. The scanner unit 21 is provided in an upper portion of the casing 2 and has a laser emitting portion (not shown), a rotatable polygonal mirror 24, lenses 25*a*, 25*b*, and a reflecting mirror 26. A laser beam emitted from the laser emitting portion is modulated based on predetermined image data. The laser beam sequentially passes through or reflects from the optical elements, that is, the polygonal mirror 24, the lens 25*a*, the reflecting mirror 26, and the lens 25*b* in order as indicated by a broken line in FIG. 1. The laser beam is thus directed to a surface of a photosensitive drum 28 in the process unit 22.

Figure 2:
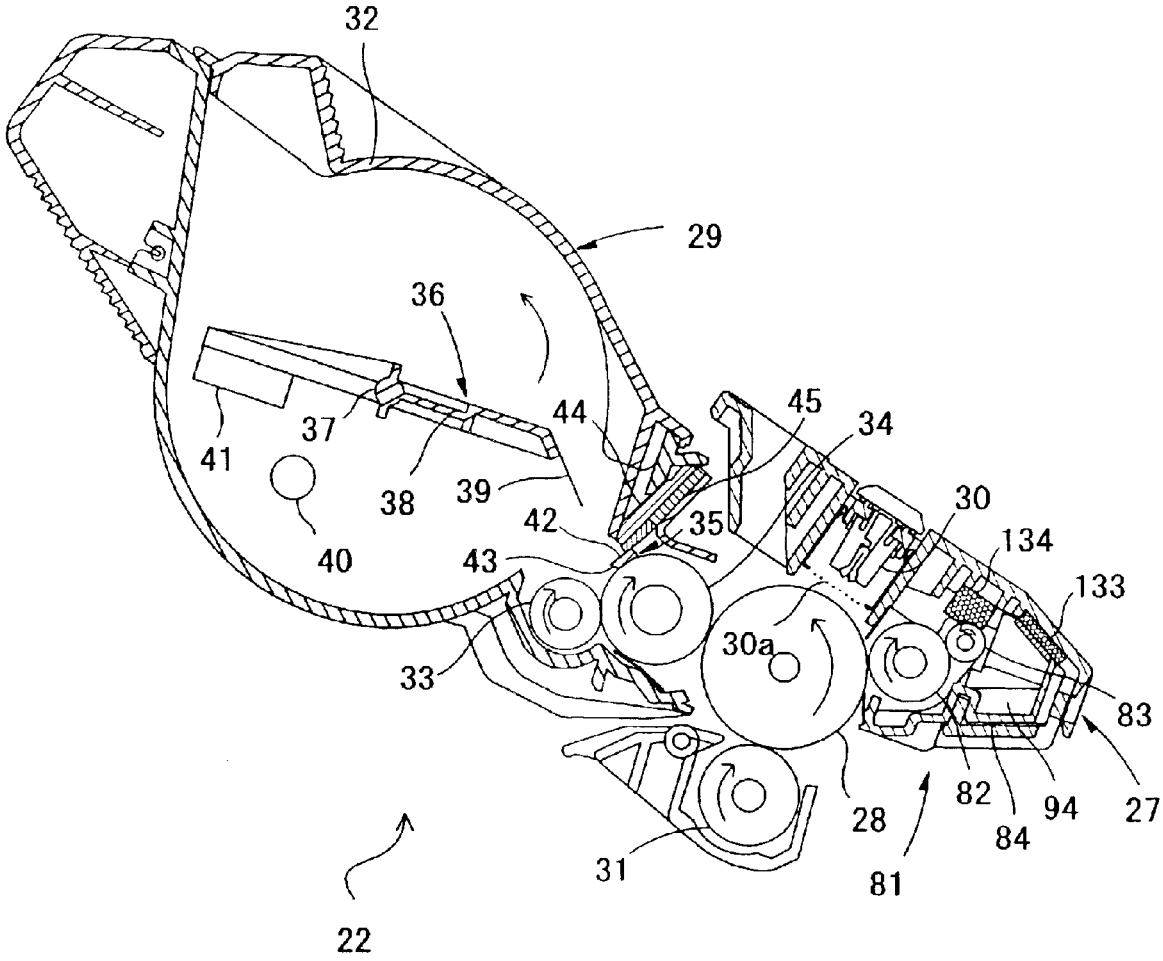
FIG. 2 is a side view of principal parts of a process unit of the laser printer shown in FIG. 1.

The process unit 22 is disposed below the scanner unit 21 and detachably attached to the casing 2. As shown in FIG. 2, the process unit 22 includes the photosensitive drum 28, a developing cartridge 29, a scorotron charger 30, a transfer roller 31, and a cleaning unit 81 in a drum frame 27, which is a housing of the process unit 22.

The developing cartridge 29 is detachably attached to the drum frame 27, and includes a toner hopper 32, a supply roller 33 disposed alongside the toner hopper 32, a developing roller 34, and a layer thickness-regulating blade 35.

The toner hopper 32 contains positively charged nonmagnetic single-component toner as a developing agent. The toner used in this embodiment is a polymerized toner obtained through copolymerization of styrene-based monomers, such as styrene, and acryl-based monomers, such as acrylic acid, alkyl (C1—C4) acrylate, or alkyl (C1—C4) methacrylate, using a known polymerization method, such as suspension polymerization. The particle shape of such a polymerized toner is spherical, its particle size is approximately 6–10 $\mu$m, and thus the polymerized toner has excellent flowability. A coloring agent, such as carbon black, and wax is added to the polymerized toner. An external additive, such as silica, is also added to the polymerized toner to improve flowability.

An agitator 36 is provided in the toner hopper 32. The agitator 36 includes a rotating shaft 37 rotatably supported at a central portion in the toner hopper 32, an agitating blade 38 provided at the side of the rotating shaft 37, and a film 39 affixed at a free end of the agitating blade 38. When the rotating shaft 37 rotates in a direction of an arrow (i.e., counter clockwise), the agitating blade 38 moves in a circumferential direction, the film 39 scrapes toner in the toner hopper 32 and supplies it to the supply roller 33. A cleaner 41 is provided on a side of the rotating shaft 37 opposite the agitating blade 38. The cleaner 41 wipes a toner detection window 40 provided on a sidewall of the toner hopper 32. The supply roller 33 is disposed diagonally downward from the toner hopper 32 so as to be rotatable in an opposite direction of the rotational direction of the agitator 36. The supply roller 33 is made by covering a metallic roller shaft with a conductive urethane sponge.

The developing roller 34 is disposed facing the supply roller 33 diagonally downward from the toner hopper 32 so as to be rotatable in the same direction as the supply roller 33. The developing roller 34 is formed by covering a metallic roller shaft with an electrically conductive urethane or silicone rubber containing fine carbon particles, with a coat of a urethane or silicone rubber containing fluorine. The roller shaft of the developing roller 34 is connected to a power supply (not shown), and receives a specified developing bias. The supply roller 33 and the developing roller 34 are disposed in contact with each other so that the supply roller 33 press-deforms against the developing roller 34 to an appropriate extent. The supply roller 33 and the developing roller 34 rotate in the opposite directions at the contact portion.

The layer thickness-regulating blade 35 is disposed so as to face the developing roller 34 along the length of the developing roller 34 above the supply roller 33 and between a contact surface of the developing roller 34 and the supply roller 33 and a contact surface of the developing roller 34 and the photosensitive drum 28 with respect to the rotational direction of the developing roller 34. The layer thickness-regulating blade 35 has a plate spring 42, a presser portion 43 disposed on a distal end of the plate spring 42 to make contact with the developing roller 34 and formed from an electrically insulative silicone rubber, a backup member 44 provided on the back of the plate spring 42, and a support member 45 that supports an end opposite to the distal end of the plate spring 42 to the developing cartridge 29. As the plate spring 42 is supported to the developing cartridge 29 by the support member 45, the layer thickness-regulating blade 35 is pressed against the developing roller 34 by the elastic force of the plate spring 42.

Toner in the toner hopper 32 is scraped by the agitator 36 and supplied to the supply roller 33. Upon rotation of the agitator 36, the cleaner 41 is rotated to wipe the window 40. Toner supplied to the supply roller 33 is supplied to the developing roller 34 when the supply roller 33 rotates. When toner is supplied from the supply roller 33 to the developing roller 34, it is positively charged between the supply roller 33 and the developing roller 34 due to friction.

The charged toner is carried on the developing roller 34, and passes between the developing roller 34 and the presser portion 43 of the layer thickness regulating blade 35 by rotation of the developing roller 34. When passing between the developing roller 34 and the presser portion 43, toner is further charged due to friction, and formed into a thin layer of a predetermined thickness on the developing roller 34.

The photosensitive drum 28 is disposed facing the developing roller 34, and is supported in the drum frame 27 so as to rotate in the opposite direction of the rotational direction of the developing roller 34. The photosensitive drum 28 is formed by coating a grounded cylindrical aluminum drum with a positively charged photosensitive layer made of polycarbonate. The photosensitive drum 28 includes a photosensitive drum driving gear 28*a* (FIG. 7), which is a helical gear, at an end.

The scorotron charger 30 is disposed above the photosensitive drum 28 so as to face the photosensitive drum 28 at a predetermined distance away, and is supported in the drum frame 27. The scorotron charger 30 produces corona discharge from a tungsten wire and positively charges the surface of the photosensitive drum 28 uniformly. A grid electrode 30*a* is provided between the wire and the photosensitive drum 28. When the photosensitive drum 28 rotates, its surface is uniformly positively charged by the scorotron charger 30. When the surface of the photosensitive drum 28 is irradiated with a laser beam emitted from the scanner unit 21 based on the predetermined image data, an electrostatic latent image is formed.

When the developing roller 34 rotates, positively charged toner on the developing roller 34 faces the photosensitive drum 28. When the toner makes contact with the photosensitive drum 28, the toner is supplied to the electrostatic latent image formed on the photosensitive drum 28. That is, the toner is supplied to a low-potential portion of the photosensitive drum 28 and selectively carried on the photosensitive drum 28. As a result, the latent image formed on the photosensitive drum 28 becomes visible.

The transfer roller 31 is disposed facing the photosensitive drum 28 beneath and is supported to rotate, in the opposite direction of the rotational direction of the photosensitive drum 28, in the drum frame 27. The transfer roller 31 is formed by covering a metallic roller shaft with an electrically conductive rubber material. A power source (not shown) is electrically connected to the roller shaft such that a predetermined transfer bias is applied to the roller shaft when toner on the photosensitive drum 28 is transferred to the sheet 3.

The sheet 3 conveyed from the resist rollers 10 makes contact with the photosensitive drum 28 along with the rotation of the photosensitive drum 28. While the sheet 3 is passing between the photosensitive drum 28 and the transfer roller 31, the toner on the photosensitive drum 28 is transferred to the sheet 3. The sheet 3 on which the toner is transferred is conveyed to the fixing unit 23 via a conveyor belt 46 as shown in FIG. 1.

The fixing unit 23 is disposed downstream with respect to the sheet conveying direction and has a heat roller 47, a pressure roller 48, and conveying rollers 49. The heat roller 47 has a halogen lamp placed in a metallic tube. The pressure roller 48 is disposed so as to be pressed into contact with the heat roller 47 from below. The conveying rollers 49 are provided downstream from the heat roller 47 and the pressure roller 48 with respect to the sheet conveying direction.

The toner transferred to the sheet 3 melts and becomes fixed onto the sheet 3 due to the applied heat, while the sheet 3 passes between the heat roller 47 and the pressure roller 48. The sheet 3 is conveyed toward conveying rollers 50 and ejecting rollers 51 by the conveying rollers 49. The conveying rollers 50 are disposed downstream from the conveying rollers 49 with respect to the sheet conveying direction. The ejecting rollers 51 are disposed above a discharged paper tray 52. The sheet 3 conveyed by the conveying rollers 49 is conveyed to the ejecting rollers 51 by the conveying rollers 50, and ejected onto the discharged paper tray 52 by the ejecting rollers 51.

In the laser printer 1, a cleaner-less developing method, in which the developing roller 34 collects the toner remaining on the photosensitive drum 28 after the toner is transferred to the sheet 3, is used. When the remaining toner is collected with this method, a scraper that scrapes the remaining toner from the photosensitive drum 28 and a storage place for the scraped toner become unnecessary. Thus, the laser printer can be simplified in structure and made compact.

The laser printer 1 is provided with a reconveying unit 61 that allows image formation on both sides of a sheet 3. The reconveying unit 61 includes a reverse unit 62 and a reconveyance unit 63, which are integrally formed. The reconveying unit 61 is detachably attached to the rear of the casing 2 such that, when attached, the reverse unit 62 is externally attached to the casing 2 and the reconveyance unit 63 is inserted into the casing 2 above the sheet feed tray 6. The reverse unit 62 is externally attached to the rear wall of the casing 2, and includes a substantially rectangular casing 64, reversing rollers 66, reconveying rollers 67, and a reverse guide plate 68, which extends upward from the casing 64.

A flapper 65 is provided downstream from the conveying rollers 49. The flapper 65 selectively shifts the direction of the sheet 3 with a printed image on one side thereof, which is conveyed by the conveying rollers 49, between two directions: one is toward the conveying rollers 50 (indicated by a solid line in FIG. 1), and the other one is toward reversing rollers 66 (indicated by a hypothetical line). The flapper 65 is swingably supported at a rear part of the casing 2, and disposed close to and downstream from the conveying rollers 49. The flapper 65 is swingably provided so as to selectively shift the direction of the sheet 3, which has an image on one side thereof and conveyed by the conveying rollers 49, between the two directions, according to the excited state of a solenoid (not shown).

The reversing rollers 66 are disposed downstream from the flapper 65 and at an upper portion of the casing 64. The reversing rollers 66 are a pair of rollers designed so as to change their rotational direction between a normal direction and a reverse direction. The reversing rollers 66 first rotate in the normal direction to convey the sheet 3 to the reverse guide plate 68, and then rotate in the reverse direction to reverse the sheet 3. The reconveying rollers 67 are disposed downstream from the reversing rollers 66 and substantially directly below the reversing rollers 66 in the casing 64. The reconveying rollers 67 are a pair of rollers designed so as to convey the sheet 3 reversed by the reversing rollers 66 to the reconveyance unit 63. The reverse guide plate 68 is made of a plate member extending upward from the upper end of the casing 64, and designed to guide the sheet 3 fed by the reversing rollers 66.

To form images on both sides of a sheet 3, the flapper 65 is shifted in the direction to convey a sheet 3 with an image formed on one side thereof to the reversing rollers 66, and the sheet 3 is received in the reverse unit 62. Thereafter, when the sheet 3 is fed to the reversing rollers 66, the reversing rollers 66 pinch the leading edge of the sheet 3 therebetween and rotate in the normal direction to convey the sheet 3 upward along the reverse guide plate 68 until much of the sheet 3 appears outside the laser printer 1. When the trailing edge of the sheet 3 is pinched between the reversing rollers 66, the reversing rollers 66 rotate in the reverse direction.

The reversing rollers 66 rotate in the reverse direction, so that the sheet 3 is conveyed to the reconveying rollers 67 with the trailing end oriented downward. The time at which the reversing rollers 66 rotate in the normal or reverse direction is controlled by a sensor 76 provided downstream from the fixing unit 23 and switched when a specified time is elapsed after the sensor 76 detects the trailing edge of the sheet 3. When the sheet 3 is completely conveyed to the reversing rollers 66, the flapper 65 is returned to its original state, that is, a state in which the sheet 3 conveyed from the conveying rollers 49 is fed to the conveying rollers 50.

When the sheet 3 is conveyed to the reconveying rollers 67, it is conveyed to the reconveyance unit 63. The reconveyance unit 63 includes a sheet supply portion 69 that supplies sheets 3, a tray 70, and two inclined rollers 71. The sheet supply portion 69 is externally attached to the rear of the casing 2 under the reverse unit 62, and includes a curved sheet guide member 72. The sheet 3 being fed from the reconveying rollers 67 substantially vertically is guided by the sheet guide member 72, and conveyed to the tray 70 substantially horizontally due to the curved shaped of the sheet guide member 72.

The tray 70 is a substantially rectangular plate, and disposed substantially horizontally above the sheet supply tray 6. The tray 70 is connected, at its upstream end, to the sheet guide member 72, and, at its downstream end, to the upstream end of a reverse conveying path 73 along which the sheet 3 is conveyed from the tray 70 to the conveying rollers 9. The downstream end of the reverse conveying path 73 extends toward the conveying rollers 9.

The inclined rollers 71 that convey the sheet 3 while causing the sheet 3 to make contact with a base plate (not shown), are spaced at a predetermined distance in the paper feed path of the tray 70. Each inclined roller 71 is disposed adjacent to the base plate (not shown), which is provided on an end of the tray 70 with respect to the width of the tray 70. Each inclined roller 71 is composed of an inclined driving roller 74 and an inclined driven roller 75. The inclined driving roller 74 is disposed such that its axis line is substantially perpendicular to the sheet conveying direction. The inclined driven roller 75 is disposed facing the inclined driving roller 74 over the sheet 3 such that its axis line is inclined from the direction substantially perpendicular to the sheet conveying direction toward a direction where the sheet conveying direction heads for a printing reference plane.

After the sheet 3 is conveyed from the sheet supply portion 69 to the tray 70, it is conveyed to the conveying rollers 9 via the reverse conveying path 73 with one end of the sheet 3 kept in contact with the base plate. The reversed sheet 3 is conveyed to the image formation position via the resist rollers 10. At the image formation position, the reversed side of the sheet 3 makes contact with the photosensitive drum 28, and toner is transferred on the reverse side to form a visible image, and fixed in place in the fixing unit 23. The sheet 3 with images formed on both sides is ejected onto the discharged paper tray 52.

The process unit 22 of the laser printer 1 is provided with the cleaning unit 81. The cleaning unit 81 temporarily catches toner that remains on the photosensitive drum 28 after transfer, and collects foreign matter or paper dust, which is shifted from the sheet 3 to the photosensitive drum 28 during transfer.

As shown in FIG. 2, the cleaning unit 81 is disposed adjacent to the photosensitive drum 28 opposite from the developing roller 34 in the drum frame 27. The cleaning unit 81 has a first cleaning roller 82, a second cleaning roller 83, and a holder 84 where the first cleaning roller 82 and the second cleaning roller 83 are supported.

Figure 3A:
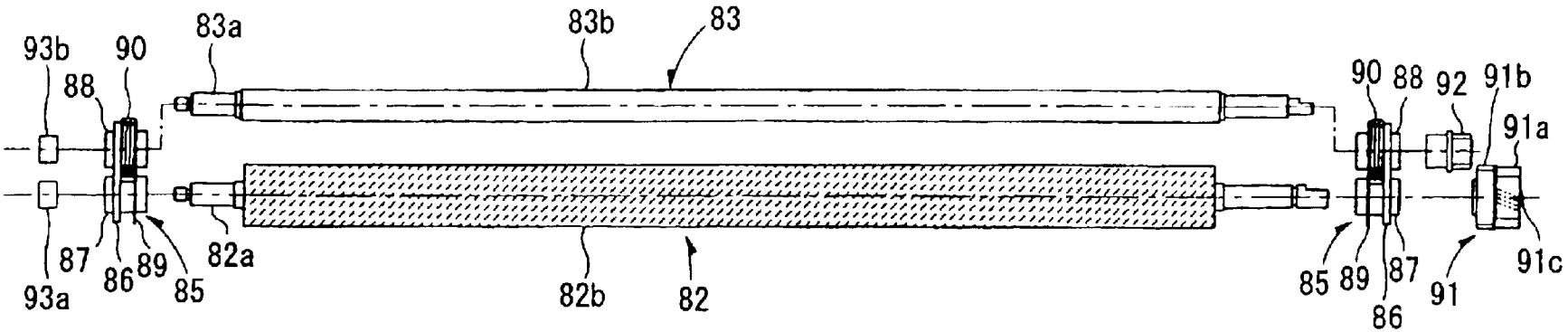
FIG. 3A is an exploded view of a first cleaning roller, a second cleaning roller, and bearings of the process unit shown in FIG. 2.
Figure 3C:
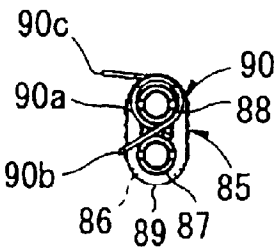
FIGS. 3B and 3C are end views of FIG. 3A.
Figure 3B:
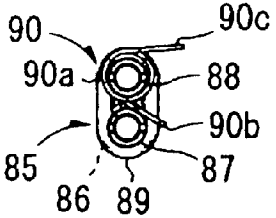

As shown in FIGS. 3A–3C, the first cleaning roller 82 has a roller shaft 82*a* and a roller portion 82*b*. The roller shaft 82*a* is formed by plating a steel material made by a drawing process with aluminum. The roller portion 82*b* is made of a conductive foam such as silicone rubber foam, urethane rubber foam, and EDPM foam. The roller portion 82*b* is provided around the roller shaft 82*a* and extends the length of the roller shaft 82*a* such that both ends of the roller shaft 82*a* are exposed.

The second cleaning roller 83 is formed by plating a steel member made by a drawing process with nickel or gilt. The second cleaning roller 83 is divided into a roller shaft 83*a* provided at each end thereof, and a roller portion 83*b* provided between each end and having a greater diameter than the roller shaft 83*a*, which are integrally formed. The roller portion 83*b* has a surface roughness of 3.2 mm or less (mean roughness depth Rz).

The diameter of the roller portion 83*b* of the second cleaning roller 83 is smaller than the diameter of the roller portion 82*b* of the first cleaning roller 82, and the overall length of the roller portion 83*b* is greater than or equal to the roller portion 82*b*. With the above structure, paper dust on the photosensitive drum 28 is favorably caught by the first cleaning roller 82, and paper dust shifted to the first cleaning roller 82 is favorably caught by the second cleaning roller 83. The overall length of the roller portion 82*b* of the first cleaning roller 82 is greater than or equal to the overall length of the image formation area of the photosensitive drum 28. Thus, the first cleaning roller 82 catches paper dust scattered all over the image formation area on the photosensitive drum 28.

The first cleaning roller 82 and the second cleaning roller 83 are rotatably supported at both ends by common bearings 85. The bearings 85 are made of a resin and each have an oval bearing plate 86, a first bearing 87, and a second bearing 88, which are integrally formed with the bearing plate 86. The first bearing 87 and the second bearing 88 are formed in a tube perpendicularly passing through the bearing plate 86, and disposed adjacently so as to insert and support the roller shaft 82*a* of the first cleaning roller 82 and the roller shaft 83*a* of the second cleaning roller 83 therein.

As shown in FIGS. 3A–3C, each bearing 85 has a side film 89 and a torsion coil spring 90. The side film 89 is a flexible film made of a resin such as polyethylene terephthalate (PET) and has substantially the same shape as the bearing plate 86, with two holes through which the first bearing 87 and the second bearing 88 pass. The torsion coil spring 90 is a steel wire and includes a coiled portion 90*a* around which the wire is coiled and spring ends 90*b*, 90*c* extending straightly from ends of the coiled portion 90*a* and spreading diagonally away from each other.

The coiled portion 90*a* of each torsion coil spring 90 is fitted around the second bearing 88 projecting inward from the bearing plate 86 with respect to the axial direction. (The axial direction is a direction parallel to the axial lengths of the first cleaning roller 82, the second cleaning roller 83, and photosensitive drum 28, and is the same direction as the widths of the holder 84, a paper dust storage portion (paper dust receiver) 94, an upper frame 110, and a lower frame 111.) In addition, the spring end 90*b* of the torsion coil spring 90 is downwardly engaged with the first bearing 87. Each side film 89 is attached to the bearing 85 to which the tension coil spring 90 is already attached, such that the two holes thereof are fitted around the first bearing 87 and the second bearing 88 projecting inward from the bearing plate 86 with respect to the axial direction.

The opposite ends of the roller shaft 82*a* of the first cleaning roller 82 are inserted into the first bearings 87, and the opposite ends of the roller shaft 83*a* of the second cleaning roller 83 are inserted into the second bearings 88. Thus, the bearings 85 are attached to the opposite ends of each of the roller shaft 82*a* and the roller shaft 83*a*.

Figures 4A, 4B, 4C:
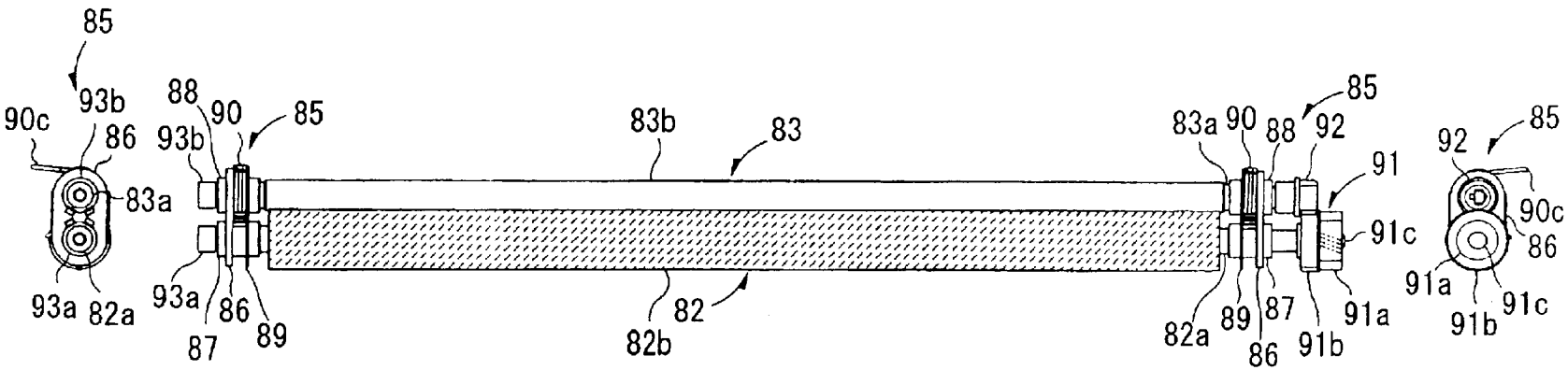
FIG. 4A is a side view of the first cleaning roller and the second roller of the process unit shown in FIG. 2.
FIGS. 4B and 4C are end views of FIG. 4A.

As shown in FIGS. 4A–4C, the first cleaning roller 82 and the second cleaning roller 83 are disposed parallel to and in contact with each other and rotatably supported by the bearings 85. With the bearings 85 attached to both ends of the roller shaft 82*a* of the first cleaning roller 82 and the roller shaft 83*a* of the second cleaning roller 83, collars 93*a*, 93*b* are provided at one ends of the roller shafts 82*a*, 83*a*. The collars 93*a*, 93*b* are substantially cylindrical in form and made of an electrically conductive resin.

With the bearings 85 attached to both ends of the roller shaft 82*a* of the first cleaning roller 82 and the roller shaft 83*a* of the second cleaning roller 83, a first cleaning roller driving gear 91 is provided at the other end of the roller shaft 82*a* of the first cleaning roller shaft 82, and a second cleaning roller driving gear 92 is provided at the other end of the roller shaft 83*a* of the second cleaning roller 83.

The first cleaning roller driving gear 91 is integrally formed with a helical gear 91*a*, which is to be in mesh with the photosensitive drum driving gear 28*a*, and a spur gear 91*b*, which is to be in mesh with the second cleaning roller driving gear 92. The helical gear 91*a* is located facing outside and the spur gear 91*b* is located facing inside with respect to the axial direction of the first cleaning roller 82. A projecting portion 91*c* is formed on an outward-end surface of the helical gear 91*a*, and projects substantially hemispherically. The second cleaning roller driving gear 92 is a spur gear, which meshes with the spur gear 91*b* of the first cleaning roller driving gear 91.

With the spur gear 91*b* of the first cleaning roller driving gear 91 and the second cleaning roller driving gear 92 meshing with each other, the first cleaning roller driving gear 91 and the second cleaning roller driving gear 92 are attached to the other end of the roller shaft 82*a* of the first cleaning roller 82 and the other end of the roller shaft 83*a* of the second cleaning roller 83, respectively.

Thus, the first cleaning roller 82 and the second cleaning roller 83 are linked through the engagement between the spur gear 91*b* and the second cleaning roller driving gear 92. The first cleaning roller 82 and the second cleaning roller 83 are controlled so as to operate with substantially a 1:1 circumferential speed ratio due to the engagement with the spur gear 91*b* and the second cleaning roller driving gear 92.

Figures 5A, 5B, 5C:
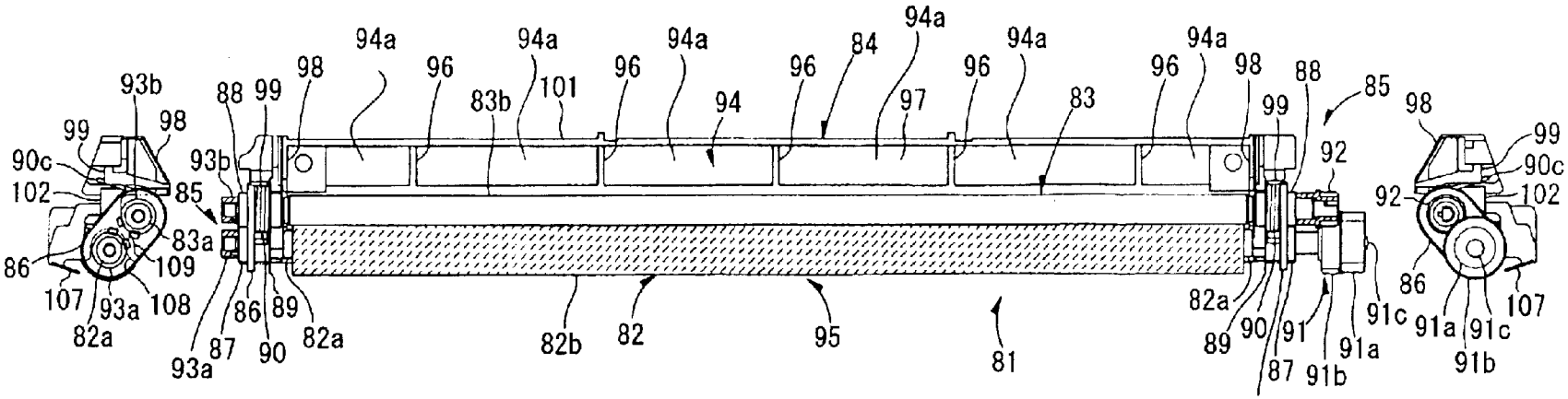
FIG. 5A is a side view of a cleaning unit of the process unit shown in FIG. 2.
FIGS. 5B and 5C are end views of FIG. 5A.

As shown in FIGS. 5A–5C, the first cleaning roller 82 and the second cleaning roller 83, which are rotatably supported by the bearings 85, are mounted to the holder 84. The holder 84 is made of a resin and comprised of a paper dust receiver 94 and a roller support portion 95.

As shown in FIGS. 5A–6B, the paper dust receiver 94 extends along the length of the holder 84 width and has a substantially rectangular shape in a plan view and an open-top box shape in a sectional side elevation view. Partition walls 96 are spaced with a predetermined distance along the width of the paper dust receiver 94. The partition walls 96 stand from the bottom wall 97 along a direction orthogonal to the width of the paper dust receiver 94 so as to partition the paper dust receiver 94 into a plurality of storage chambers 94*a*. The height of the partition walls 96 is set such that, when the upper frame 110 and the lower frame 111 are assembled as described later, the upper ends of the partition walls 96 are away from the ceiling portion 130 of the upper frame 110 so as to provide a communication through an upper space 94*b* of the plurality of storage chambers 94*a* in the width direction of the paper dust receiver 94.

Figure 13:
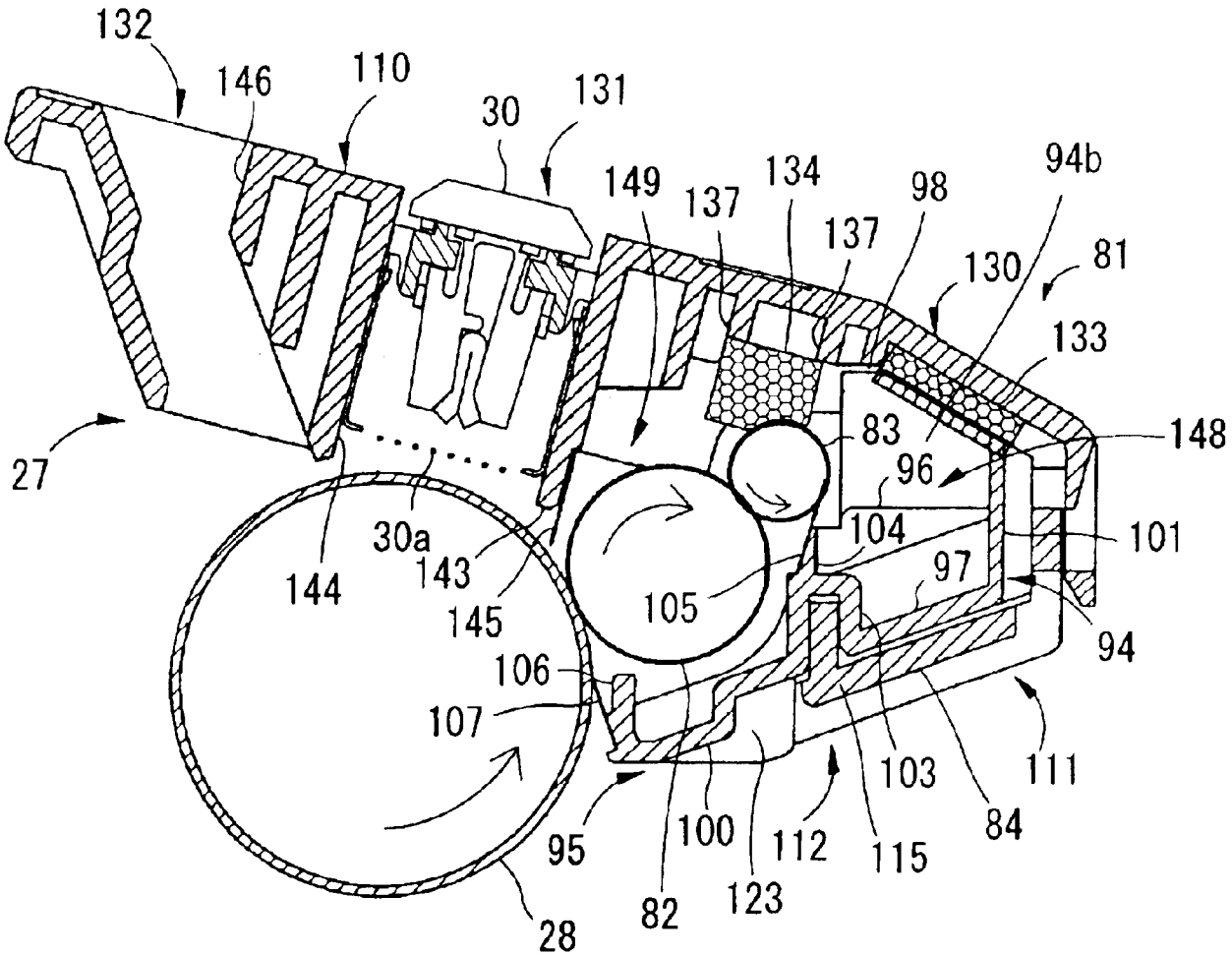
FIG. 13 is a fragmentary sectional view showing that a holder-side partition rib is in contact with a sponge seal in the process unit shown in FIG. 2.

A holder-side partition rib 98 and a spring receiver 99, which is placed outward therefrom in the axial direction, are provided on each end of the paper dust receiver 94 of the holder 84. The holder-side partition rib 98 stands upward at each end along a direction orthogonal to the axial direction. The upper end of the holder-side partition rib 98 is inclined so as to fit the ceiling portion 130 (FIG. 13) of the upper frame 110, as shown in FIGS. 5B and 5C. The height of the holder-side partition rib 98 is set such that, when the upper frame 110 and the lower frame 111 are assembled, the upper end makes contact with a sponge seal 133 and is disposed at a predetermined distance away from the ceiling portion 130 of the upper frame 110 (FIG. 13).

The spring receiver 99, in the form of a plate, is disposed outwardly of the holder-side partition rib 98 from a predetermined distance. The spring receiver 99 is formed along the axial direction so as to face the spring end 90*c* of the torsion coil spring 90 when the first cleaning roller 82 and the second cleaning roller 83 are supported in the holder 84.

At the front-end portion of the paper dust receiver 94, a front wall 101 is formed along the width of the paper dust receiver 94 bending upwardly from the bottom wall 97. The sponge seal 133 is disposed in contact with the front wall 101. (Hereinafter, the front is on the side of the cleaning unit 81 in the process unit 22, and the rear is on the side of the developing cartridge 29.)

Figure 6B:
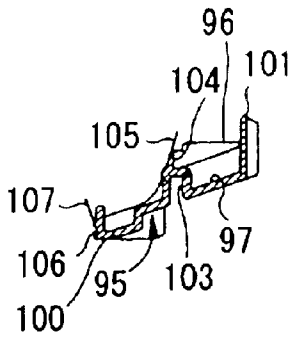
FIG. 6B is a cross sectional view of the holder of the process unit shown in FIG. 2, taken along the line I—I of FIG. 6A.

The roller support portion 95 is integrally formed with the paper dust receiver 94 at the rear of the paper dust receiver 94. The roller support portion 95 has a bottom wall 100, which is formed along the width of the roller support portion 95, and bearing support portions 102, which are provided at both ends thereof to support the bearings 85. The bottom wall 100 of the roller support portion 95 has an irregular surface as shown in FIG. 6B and is continuously formed from the bottom wall 97 of the paper dust receiver 94. A groove (recess) 103 is formed between the bottom wall 100 of the roller support portion 95 and the bottom wall 97 of the paper dust receiver 94 along the width direction.

A seal affixing portion 104, which is inclined from the bottom rear side toward the top front side, projects from a portion that defines the groove 103 along the width direction. A mid film 105 is affixed onto the inclined surface of the seal affixing portion 104. The mid film 105 has substantially a rectangular shape, is a flexible film made of a resin such as polyethylene terephthalate (PET), and provided such that its free end faces frontward along the inclined surface of the seal affixing portion 104.

A rear wall 106 is formed at the rear end of the bottom wall 100 of the roller support portion 95 bending upwardly from the rear end thereof. The rear wall 106 has an inclined surface, which is inclined from the bottom front side to the top rear side. A lower film 107 is affixed to the inclined surface of the rear wall 106 along the width direction. The lower film 107 has substantially a rectangular shape, is a flexible film made of a resin such as polyethylene terephthalate (PET), and provided such that its free end faces along the inclined surface of the rear wall 106 toward the rotational direction of the photosensitive drum 28.

Figure 6A:
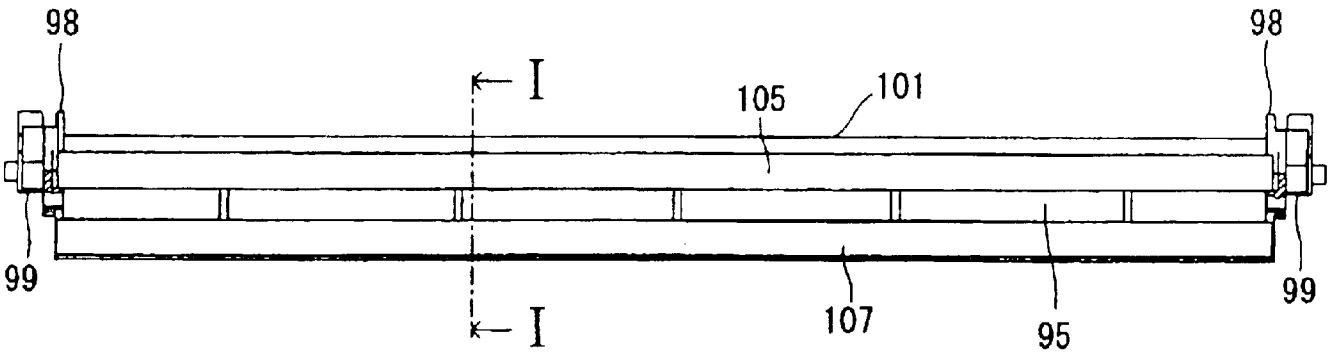
FIG. 6A is a side view of a holder of the process unit shown in FIG. 2.

As shown in FIG. 6A, the mid film 105 and the lower film 107 have a longitudinal length greater than or equal to the roller portion 82*b* of the first cleaning roller 82. As shown in FIG. 5B, each of the bearing support portions 102 in the form of a plate is formed with a first bearing holding recess 108 that receives the first bearing 87, and a second bearing recess 109 that receives the second bearing 88. The bearings 85 are mounted on the roller support portion 95 of the holder 84 and supported in the holder 84.

With the torsion coil spring 90 engaged with the spring receiver 99, as shown in FIGS. 5B and 5C, the first bearing 87 and the second bearing 88 of which project inwardly from the bearing plate 86 with respect to the axial direction are loosely inserted into the first bearing holding recess 108 and the second bearing recess 109 at each bearing support portion 102, respectively. Thus, the second bearing 88 is downwardly urged by the torsion coil spring 90, and each bearing 85 is mounted in the holder 84.

With the first bearing 87 and the second bearing 88 of each bearing 85 loosely inserted into the first bearing holding recess 108 and the second bearing recess 109 of each bearing support portion 102, the first cleaning roller 82 and the second cleaning roller 83 are integrally movable in the front and rear direction. The torsion coil spring 90 usually urges the second cleaning roller 83 downwardly such that the surface of the second cleaning roller 83 contacts the surface of the first cleaning roller 82. The torsion coil spring 90 also usually urges the first cleaning roller 82 rearward such that the surface of the first cleaning roller 82 contacts the surface of the photosensitive drum 28.

When the first cleaning roller 82 and the second cleaning roller 83 are supported in the holder 84, the mid film 105 faces in contact with the second cleaning roller 83 from a lower place thereof, as shown in FIG. 13. The mid film 105 makes contact with the second cleaning roller 83 along the axial direction thereof such that the free end of the mid film 105 faces downstream of the rotational direction of the second cleaning roller 83. Thus, when the upper frame 110 and the lower frame 111 are assembled, the paper dust receiver 94 and the first cleaning roller 82 are partitioned by the mid film 105 at the lower place of the second cleaning roller 83.

Figure 7:
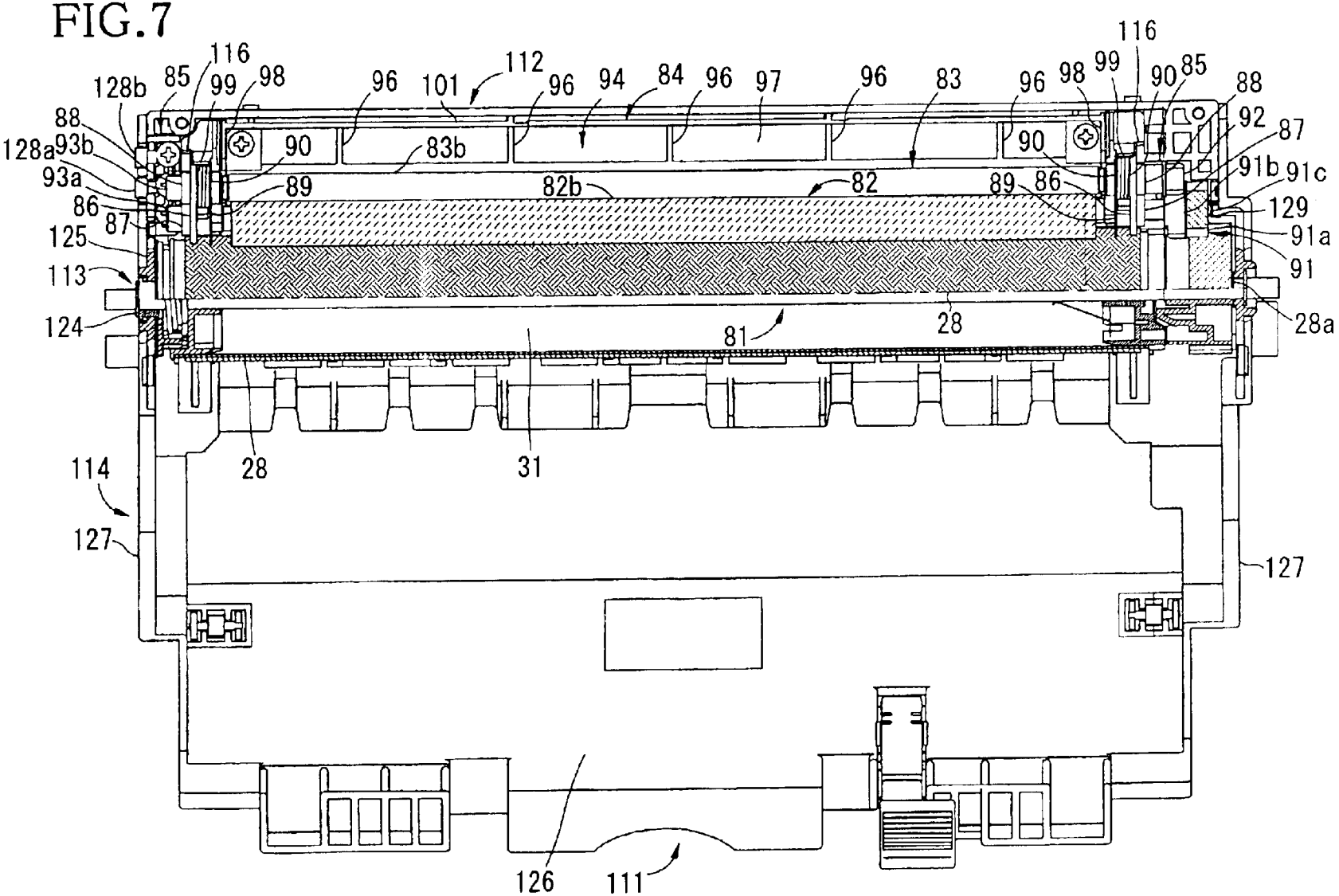
FIG. 7 is a top plan view of a lower frame of the process unit shown in FIG. 2 when the holder is attached.

As shown in FIG. 7, the holder 84, the first cleaning roller 82, and the second cleaning roller 83 are assembled as the cleaning unit 81, and mounted in the drum frame 27. The drum frame 27 is divided into the upper frame 110 and the lower frame 111 as shown in FIG. 13. With the holder 84 assembled to the lower frame 111, the upper frame 110 and the lower frame 111 are assembled, so that the cleaning unit 81 is disposed between the upper frame 110 and the lower frame 111.

The lower frame 111 is made of a resin. As shown in FIGS. 7 to 10, the lower frame 111 is comprised of, from the front to the rear, a holder mounting portion 112 to which the holder 84 is mounted, a drum mounting portion 113 to which the photosensitive drum 28 and the transfer roller 31 are mounted, and a cartridge mounting portion 114 to which the developing cartridge 29 is mounted, and all of which are integrally formed.

Figure 10:
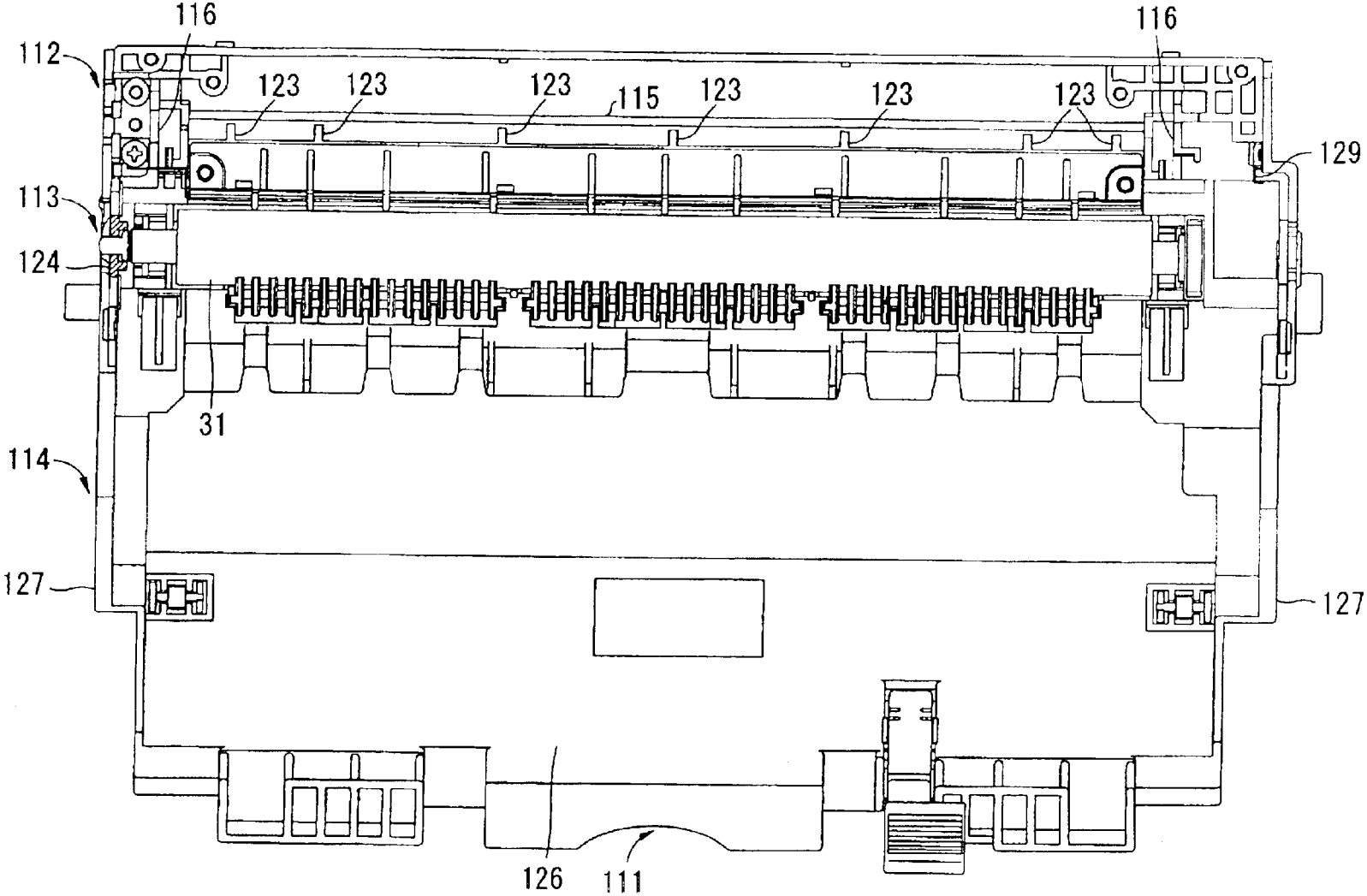
FIG. 10 is a top plan view of the lower frame of the process unit shown in FIG. 2 when the holder is not attached.

The holder mounting portion 112 is provided at the front-end portion of the lower frame 111. As shown in FIGS. 10 and 13, the holder mounting portion 112 has a projection 115 formed along the width direction, and lower-side support ribs 116 formed in a direction orthogonal to the width direction at the opposite ends. The projection 115 projects upward from the holder mounting portion 112 so as to fit in the groove 103 of the holder 84 when the holder 84 is assembled to the lower frame 111.

Figure 15:
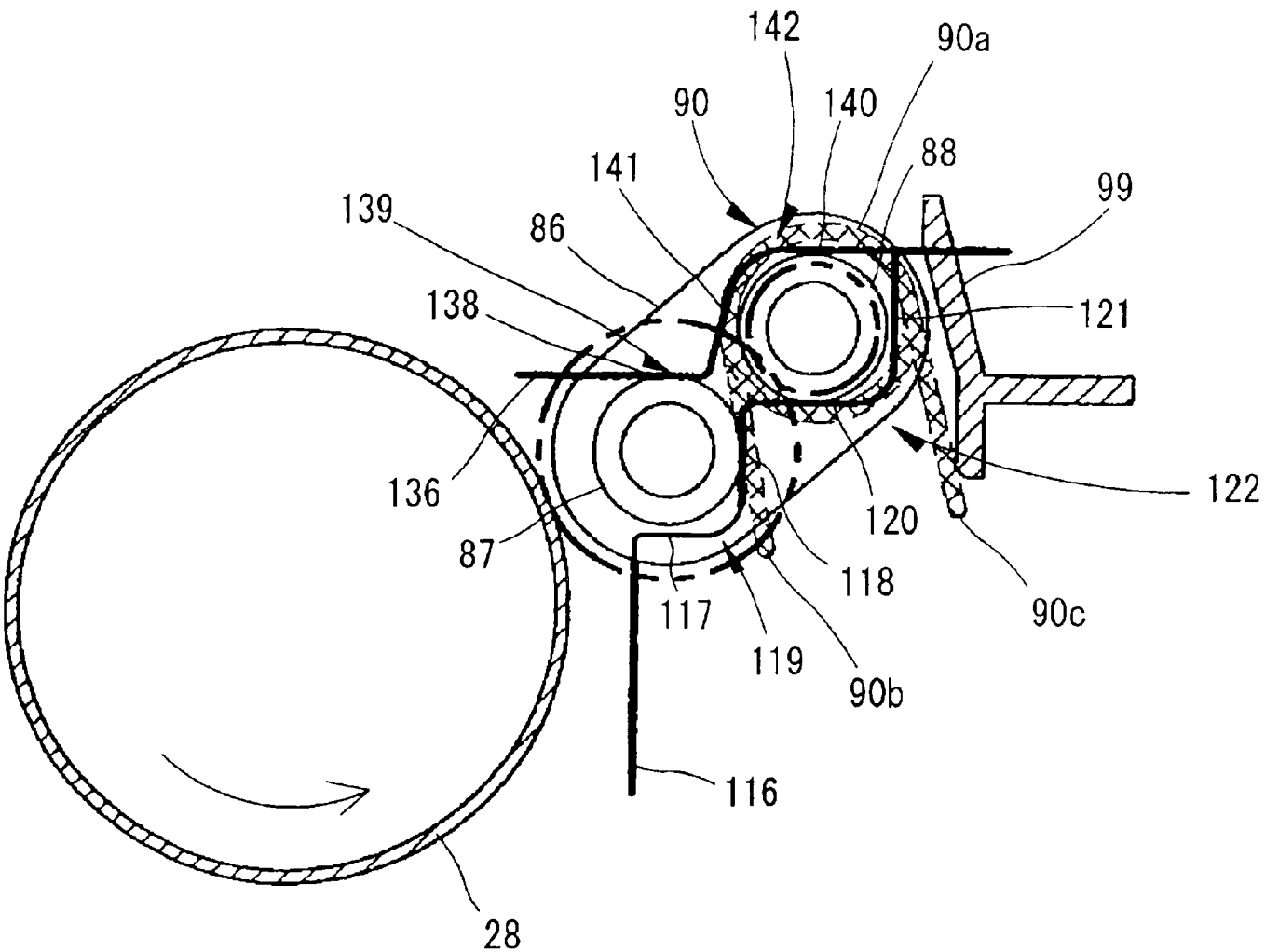
FIG. 15 shows a lower-side support rib and an upper-side support rib disposed at a gear side in the process unit shown in FIG. 2.
Figure 16:
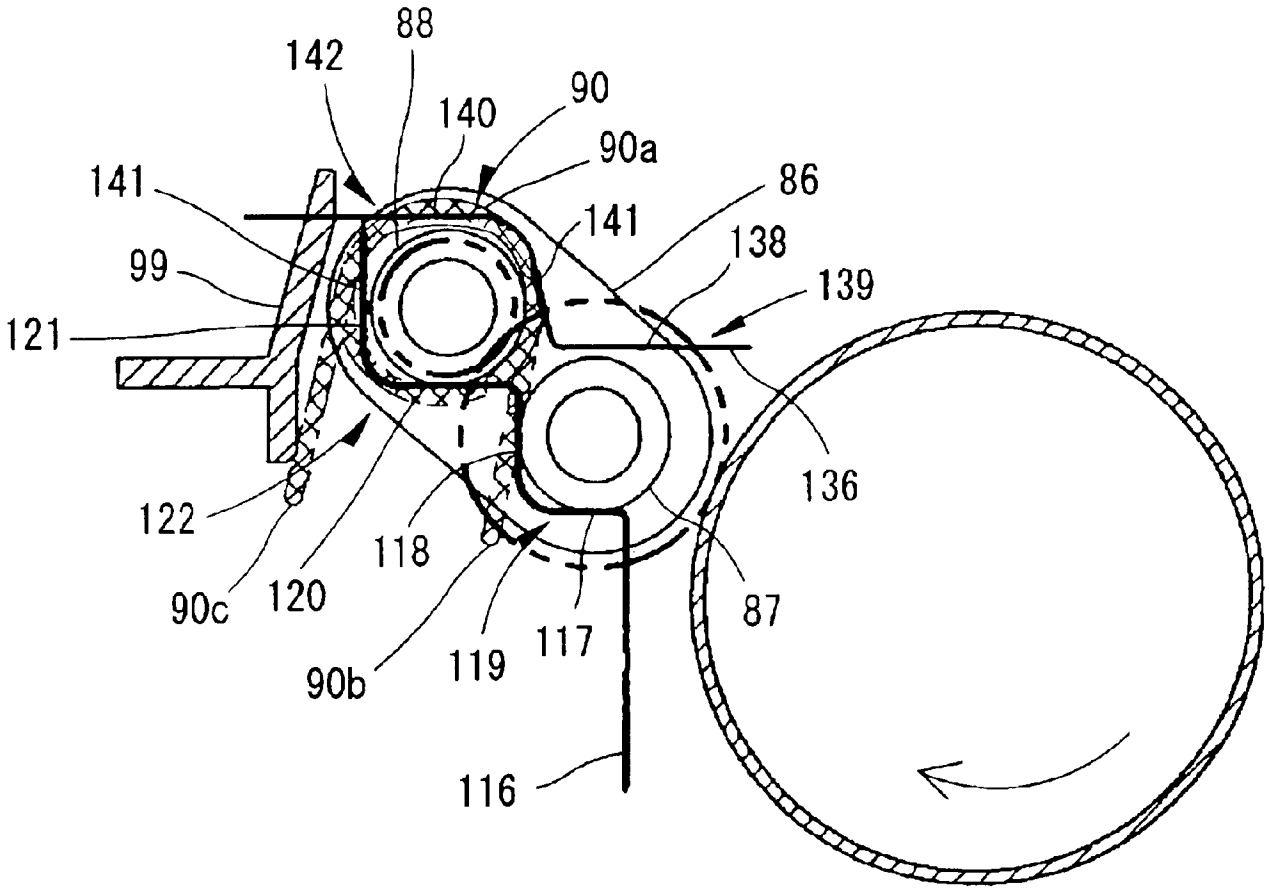
FIG. 16 shows a lower-side support rib and an upper-side support rib disposed at an electrode side in the process unit shown in FIG. 2.

The lower-side support ribs 116 project upward so as to face the first bearings 87 and the second bearings 88 of which outwardly project from the bearing plates. 86 with respect to the axial direction at opposite ends of the holder mounting portion 112. As shown in FIGS. 15 and 16, each lower-side support rib 116 is formed in two steps of an L-shaped first-side portion 119 and an L-shaped second-side receiving portion 122. The first-side receiving portion 119 has a first-side lower face 117 that faces the lower part of the first bearing 87 and a first-side front face 118 that faces the front part of the first bearing 87. The second-side receiving portion 122 includes a second-side lower face 120 that faces the lower part of the second bearing 88 and a second-side front face 121 that faces the front part of the second bearing 88.

The first-side lower face 117 of the lower-side support rib 116, which is disposed at as end, facing electrode plates 128*a* and 128*b*, of the first cleaning roller 82 (hereinafter referred to as an electrode-side end), is set at such a height as to press the first bearing 87 from below when the upper frame 110 and the lower frame 111 are assembled, as shown in FIG. 16. The first-side lower face 117 of the lower-side support rib 116, which is disposed at the other end, facing a slide plate 129, of the first cleaning roller 82 (hereinafter referred to as a gear-side end), is set at such a height as to make out of contact with the first bearing 87 when the upper frame 110 and the lower frame 111 are assembled, as shown in FIG. 15.

The first-side front faces 118 of the lower-side support ribs 116 are set so as to determine the positioning of the first cleaning roller 82 with respect to the photosensitive drum 28 when the upper frame 110 and the lower frame 111 are assembled. Holder receiving ribs 123 that receive the roller support portion 95 of the holder 84 are spaced at a predetermined distance away from each other along the width direction at the rear of the projection 115.

Figure 8:
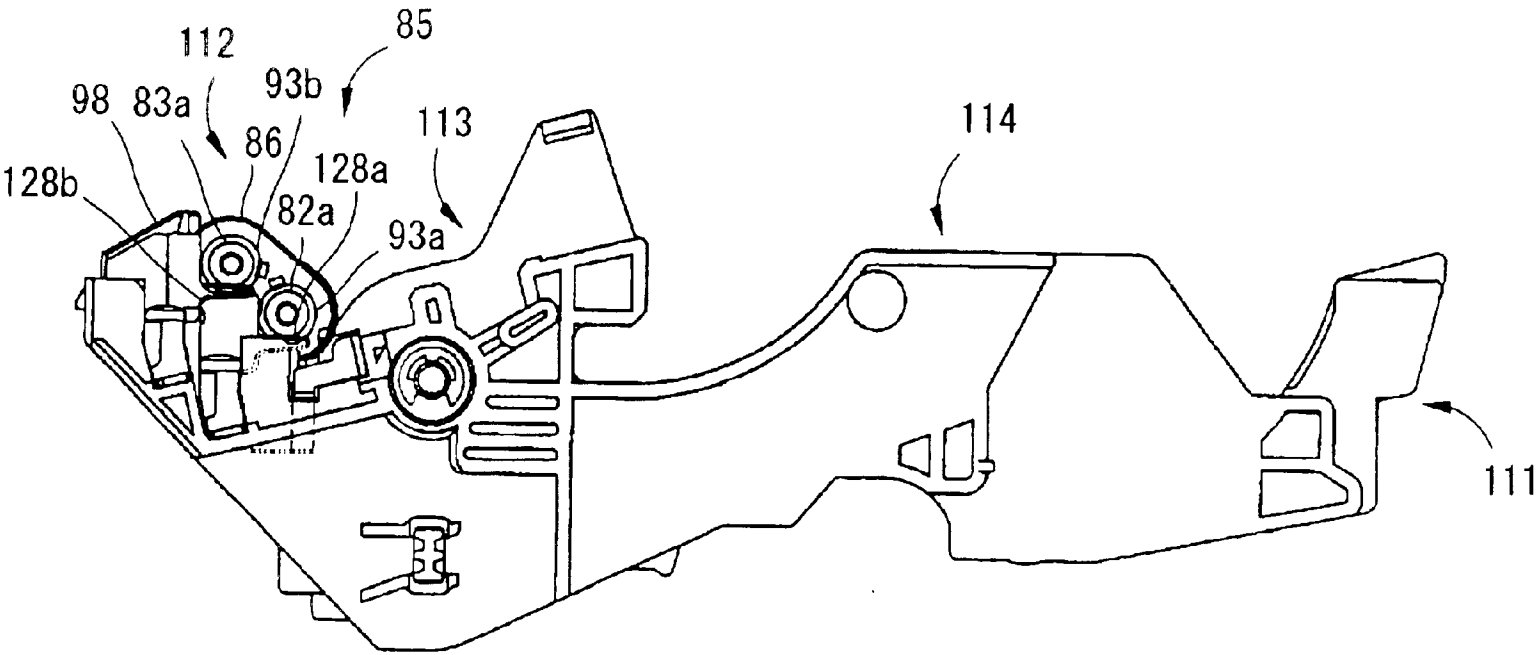
FIG. 8 is a left end view of the lower frame shown in FIG. 7.
Figure 9:
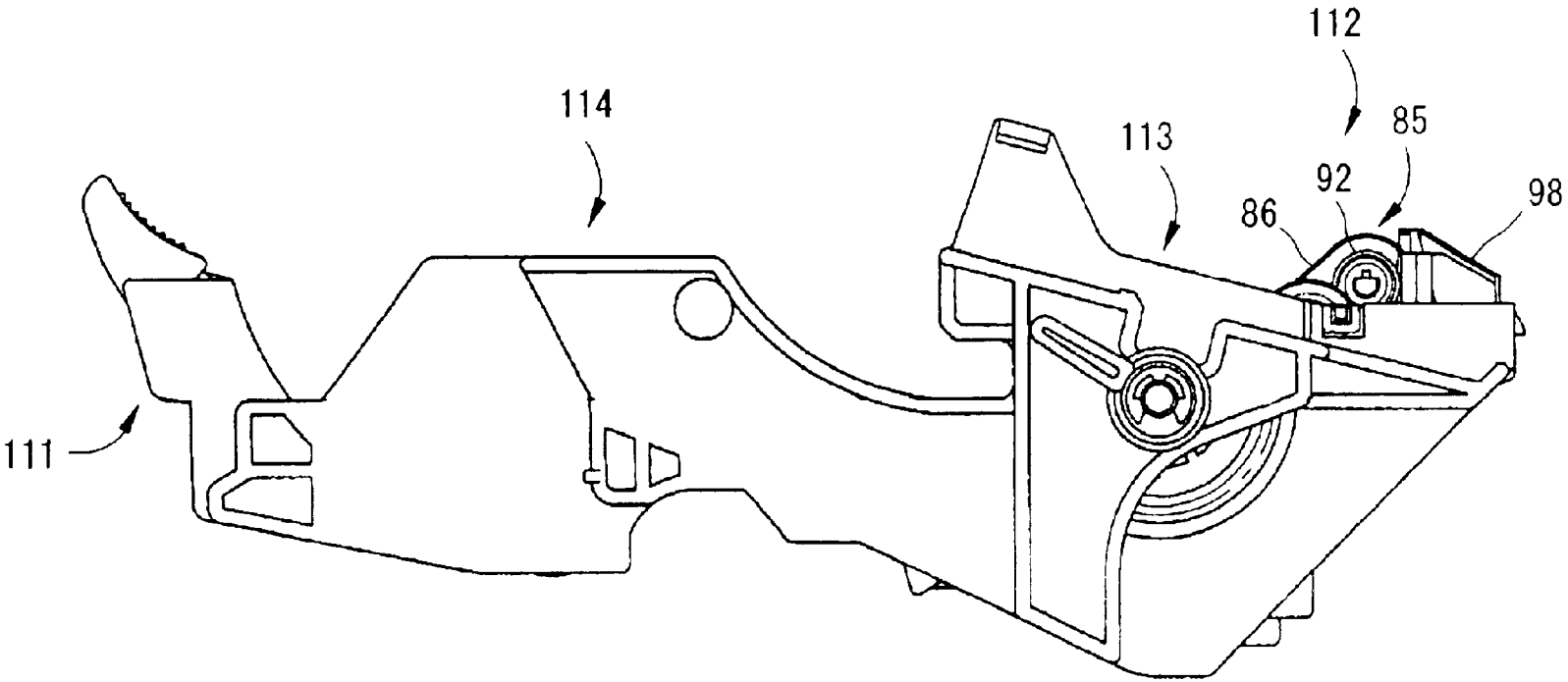
FIG. 9 is a right end view of the lower frame shown in FIG. 7.

As shown in FIGS. 7 and 8, the two electrode plates 128*a* and 128*b* are provided at the electrode-side end of the holder mounting portion 112. The electrode plates 128*a* and 128*b* are disposed so as to face in contact with the circumferential surfaces of the collars 93*a*, 93*b* outside, with respect to the width direction, from the lower-side support rib 116 formed at the electrode-side end. The slide plate 129, made of metal, is disposed so as to face the projecting portion 91*c* of the first cleaning roller driving gear 91 at the gear-side end of the holder mounting portion 112, as shown in FIG. 7.

The drum mounting portion 113 is provided at the rear of the holder mounting portion 112. The drum mounting portion 113 has, at a lower portion, a transfer roller supporting portion 124 where the transfer roller 31 is rotatably supported as shown in FIG. 10, and, at an upper portion, a photosensitive drum supporting portion 125 where the photosensitive drum 28 is rotatably supported as shown in FIG. 7.

The cartridge mounting portion 114 has a receiving plate portion 126 in the form of substantially a rectangle in a plan view where the developing cartridge 29 is received, and a side plate portion 127 bending upward from each end of the receiving plate portion 126.

Figure 11:
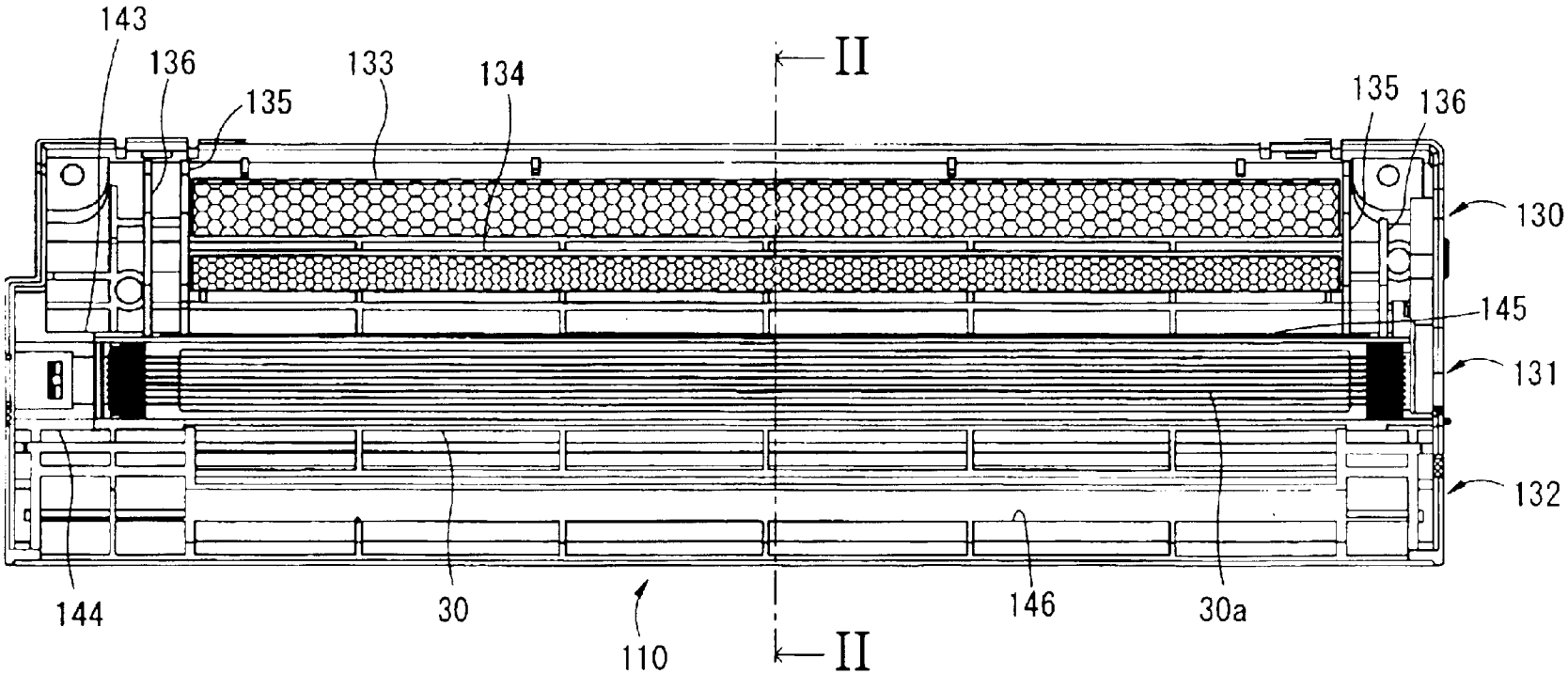
FIG. 11 is a bottom plan view of an upper frame of the process unit shown in FIG. 2.
Figure 12:
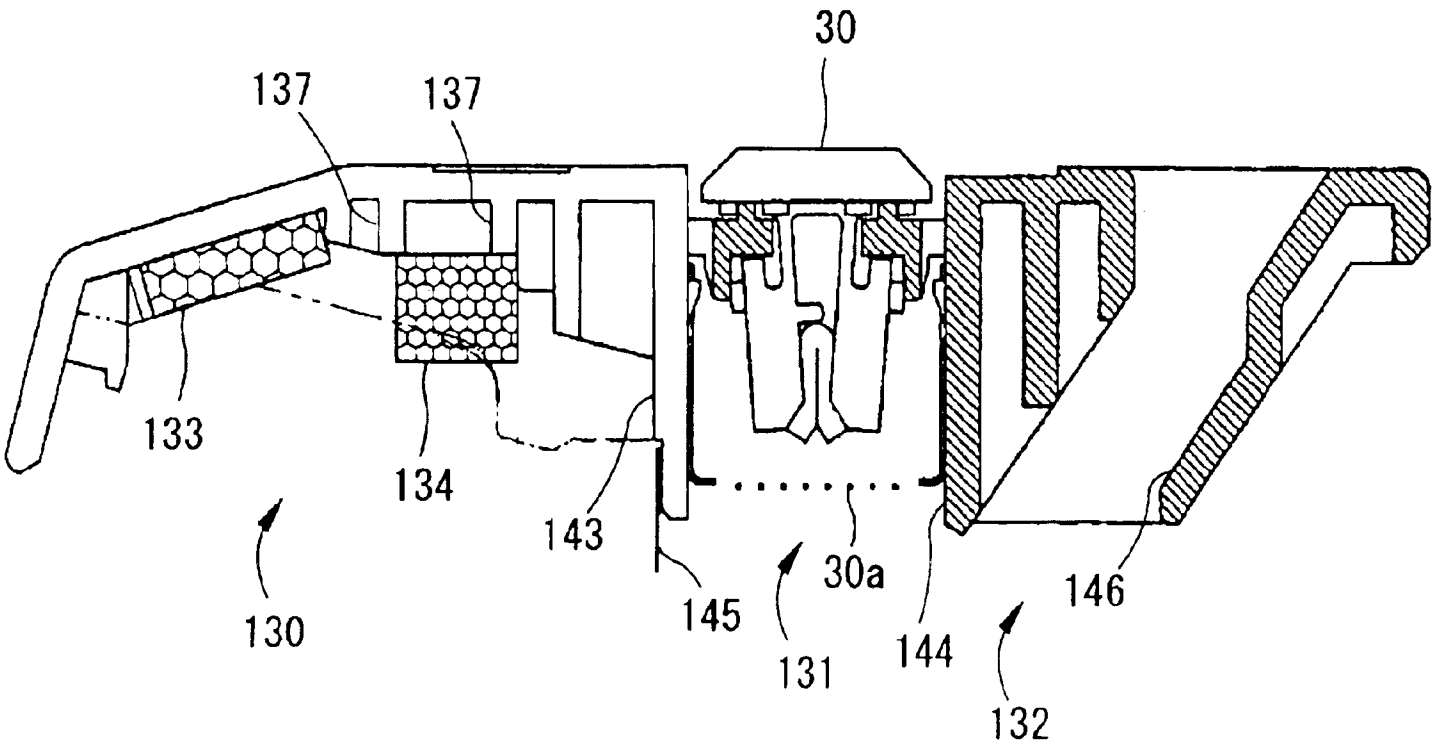
FIG. 12 is a cross sectional view of the upper frame of the process unit shown in FIG. 2, taken along the line II—II of FIG. 11.

The upper frame 110 is made of a resin, and has substantially a rectangular shape in a bottom view, as shown in FIGS. 11 and 12. The upper frame 110 is comprised of, from the front to the rear, a ceiling portion 130 that covers the cleaning unit 81, a charger supporting portion 131 where the scorotron charger 30 is supported, a laser beam passing portion 132 where a laser beam emitted from the scanner unit 21 is applied to the photosensitive drum 28, all of which are integrally formed.

The ceiling portion 130 is disposed at the front end of the upper frame 110. As shown in FIG. 13, the ceiling portion 130 includes the sponge seal 133, a sponge scraper 134, which are formed along the width direction. The ceiling portion 130 further includes ceiling-side partition ribs 135 and upper support ribs 136, which are formed along a direction orthogonal to the width direction, at both ends.

The sponge seal 133 in the form of substantially a rectangle is supported at the front end of the ceiling portion 130 along the width direction so as to face the bottom wall 97 of the paper dust receiver 94 when the upper frame 10 and the lower frame 111 are assembled.

Figure 17A:
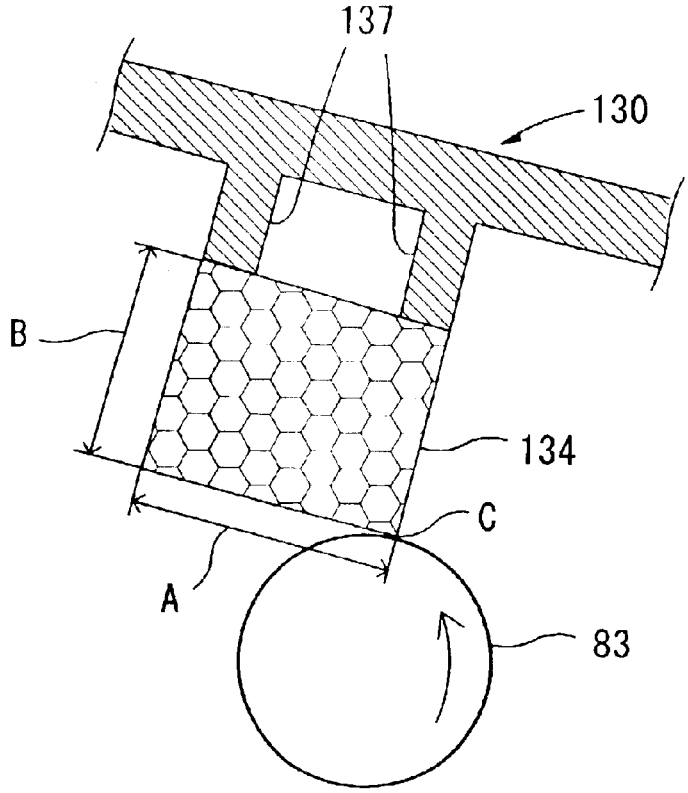
FIGS. 17A and 17B show a sponge scraper in the process unit shown in FIG. 2.

The sponge scraper 134 is substantially rectangular in a plan view, and disposed at a predetermined distance away from and parallel to the sponge seal 133 at the rear of the sponge seal 133. The sponge scraper 134 is supported at horizontal ribs 137 projecting from the ceiling portion 130 along the width direction. The sponge scraper 134 is made of a urethane sponge such that a coefficient of friction of the sponge scraper 134 to the second cleaning roller 83 is smaller than a coefficient of friction of the first cleaning roller 82 to the second cleaning roller 83. The sponge scraper 134 is formed to resist being inclined from the contact portion with the second cleaning roller 83 toward the downstream side of the rotational direction of the second cleaning roller 83. More specifically, as shown in FIG. 17A, a length A (width) of the sponge scraper 134, which extends from a contact portion C between the sponge scraper 134 and the second cleaning roller 83 tangentially, is set longer than a length B (thickness) of the sponge scraper 134, which extends in an orthogonal direction to the tangential direction.

The ceiling-side partition ribs 135 project downward and extend in a direction orthogonal to the width direction of the upper frame 110 so as to face between the holder-side partition rib 98 and the spring receiver 99 at each end of the sponge seal 133 and the sponge scraper 134.

The upper support ribs 136 are located externally at a predetermined distance away from, and parallel to, the ceiling-side partition ribs 135. The upper support ribs 136 project downward and extend in the direction orthogonal to the width direction of the upper frame 110. The upper support ribs 136 are formed so as to face the lower-side support ribs 116 via the first bearing 87 and the second bearing 88 of which project outwardly in the axial direction from the bearing plate 86.

Each of the upper support ribs 136 is formed in a step of a first-side holding portion 139 and an L-shaped second-side holding portion 142. The first-side holding portion 139 has a first-side upper face 138 that faces the upper part of the first bearing 87, and the second-side holding portion 142 has a second-side upper face 140 that faces the upper part of the second bearing 88 and a second-side rear face 141 that faces the rear side of the second bearing 88.

More specifically, the first-side upper face 138 of the upper support rib 136, which is disposed at the electrode-side end of the first cleaning roller 82, is set at such a height as to make it out of contact with the first bearing 87 when the upper frame 110 and the lower frame 111 are assembled, as shown in FIG. 16. The first-side upper face 138 of the upper support rib 136, which is disposed at the gear-side end of the first cleaning roller 82, is set at such a height so as to press the first bearing 87 from top when the upper frame 110 and the lower frame 111 are assembled, as shown in FIG. 15.

The charger supporting portion 131 is provided at the rear of the ceiling portion 130. As shown in FIG. 12, a front-side support rib 143 and a rear-side support rib 144 project downward and extend in the width direction of the charger supporting portion 131 facing each other at a predetermined distance. The scorotron charger 30 is disposed between the front-side support rib 143 and the rear-side support rib 144 along the width direction. A grid electrode 30*a* is provided between the front-side support rib 143 and the rear-side support rib 144 with its lines at a predetermined distance away from each other along the width direction.

An upper film 145 is affixed to the front side of the lower end of the front-side support rib 143 along the width direction. The upper film 145 is substantially rectangular and is a flexible film made of a resin such as polyethylene terephthalate (PET). The upper film 145 is disposed along the front side of the front-side support rib 143 such that its free end faces downward. The upper film 145 has a longitudinal length greater than or equal to the roller portion 82*b* of the first cleaning roller 82.

The laser beam passing portion 132 is provided behind the charger supporting portion 131, and has a laser beam passage 146 opening inclined toward a bottom front side, through which a laser beam from the scanner unit 21 is applied to the photosensitive drum 28.

The holder 84 is mounted to the holder mounting portion 112 of the lower frame 111 between the groove 103 of the holder 84 and the projection 115, as shown in FIG. 13. Thus, the holder 84 is placed in the lower frame 111. With this mounting, as shown in FIG. 2, the first cleaning roller 82 is disposed facing the photosensitive drum 28 so as to be located, with respect to the rotational direction of the photosensitive drum 28, downstream from a place which the transfer roller 31 makes contact with the photosensitive drum 28, and upstream from a place which the scorotron charger 30 faces the photosensitive drum 28. The second cleaning roller 83 is disposed on the opposite side of the first cleaning roller 81 from the photosensitive drum 28. The paper dust receiver 94 is disposed on the opposite side of the first cleaning roller 82 from the second cleaning roller 83.

As shown in FIGS. 15 and 16, each of the lower-side support ribs 116 of the lower frame 111 faces the corresponding bearing plate 86 supporting the first bearing 87 and the second bearing 88 from below and outside the bearing plate 86 in the axial direction. As the lower part and the front part of each first bearing 87 face the first-side lower face 117 and the first-side front face 118 respectively, each first bearing 87 is received at the corresponding first-side receiving portion 119. As the lower part and the front part of each second bearing 88 face the second-side lower face 120 and the second-side front face 121 respectively, each second bearing 88 is received at the second-side receiving portion 122.

As shown in FIG. 13, the lower film 107 faces the photosensitive drum 28 at the side thereof. The lower film 107 makes contact with the photosensitive drum 28 along its axial direction such that the free end of the lower film 107 faces toward the downstream side of the rotational direction of the photosensitive drum 28.

As shown in FIG. 8, the electrode plates 128*a* and 128*b* make sliding contact with the circumferential surfaces of the collars 93*a* and 93*b* provided on one end of the roller shafts 82*a* and 83*a* of the first cleaning roller 82 and the second cleaning roller 83 from below of the collars 93*a*, 93*b*.

As shown in FIG. 7, with the engagement between the photosensitive drum driving gear 28*a* and the helical gear 91*a*, the photosensitive drum 28 and the first cleaning roller 82 are linked and set so as to be actuated with the circumferential velocity ratio of about one to two. The slide plate 129 is disposed facing the projecting portion 91*c* of the first cleaning roller driving gear 91.

When the upper frame 110 is mounted to the lower frame 111 with the holder 84 mounted thereon, each of the first bearings 87 is held between the corresponding first-side receiving portion 119 and first-side holding portion 139, as shown in FIGS. 15 and 16. Each of the second bearings 88 is held between the corresponding second-side receiving portion 122 and second-side holding portion 142. Thus, each of the bearings 85 is pinched between the corresponding upper support rib 136 of the upper frame 110 and lower-side support rib 116 of the lower frame 111 from above and below. More specifically, the first cleaning roller 82 is placed in position horizontally because the first bearing 87 is pressed from below by the first-side lower face 117 at one end as shown in FIG. 16 and pressed from above by the first-side upper face 138 at the other end as shown in FIG. 1S. The first bearings 87 are brought in contact with the first-side front faces 118 at both ends of the first cleaning roller 82, so that the first cleaning roller 82 is placed in position with respect to the photosensitive drum 28. The first cleaning roller 82 positioned in this manner is always urged by the torsion coil springs 90 toward the photosensitive drum 28.

The second cleaning roller 83 is loosely held at each end between the second-side receiving portion 122 and the second-side holding portion 142 with the second bearing 88 received at the second-side receiving portion 122 at each end of the second cleaning roller 83.

Figure 14:
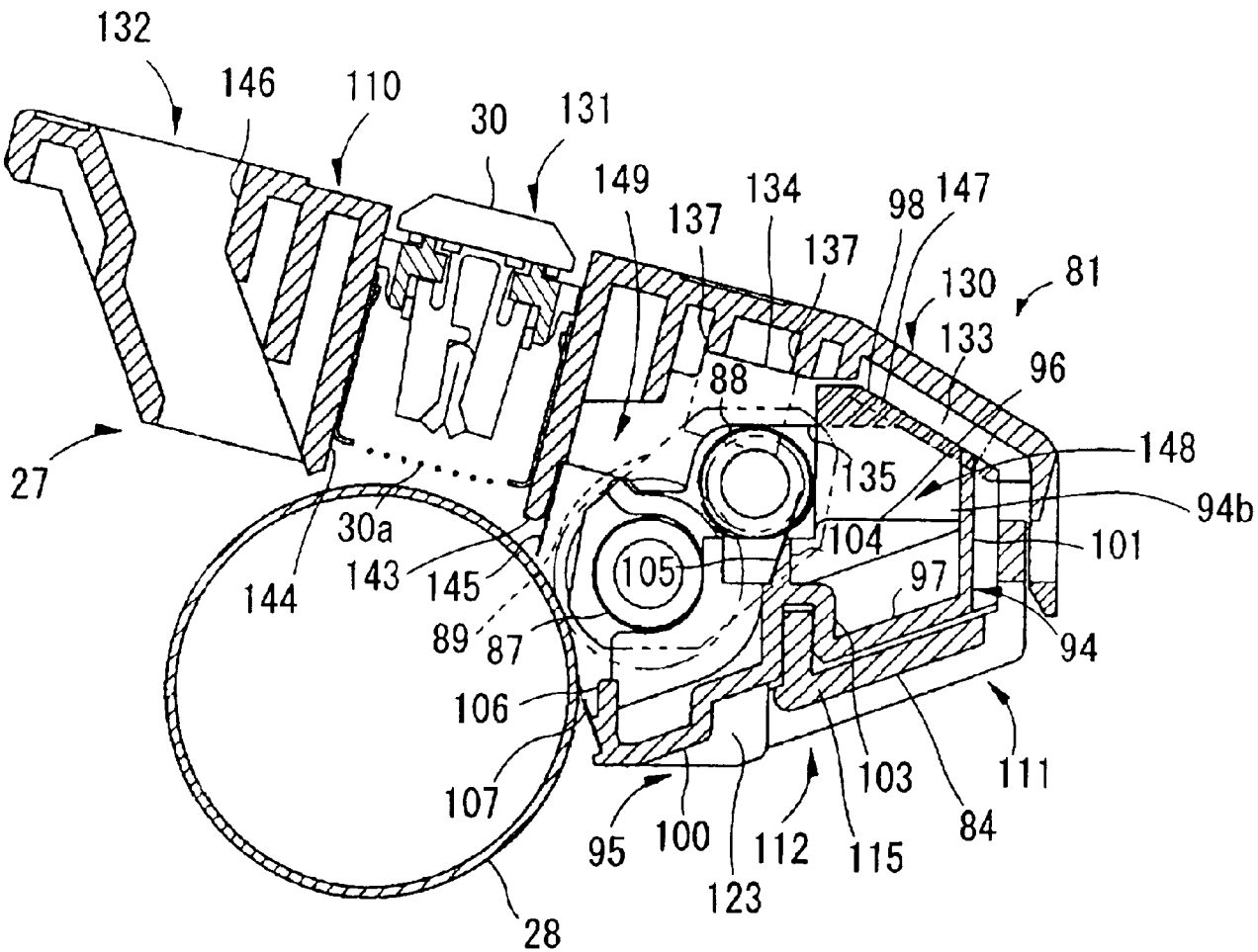
FIG. 14 is a fragmentary sectional view showing that the holder-side partition rib and a ceiling-side partition rib overlap in the process unit shown in FIG. 2.

When the upper frame 110 is mounted to the lower frame 111 with the holder 84 mounted thereon, each ceiling-side partition rib 135, shown in FIG. 11, is received between the holder-side partition rib 98 and the spring receiver 99 at each end shown in FIG. 7. Thus, the holder-side partition rib 98 and the ceiling-side partition rib 135 overlap each other in the width direction at each end of the paper dust receiver 94, so that an overlap portion 147 is formed as shown in FIG. 14. The overlap portion 147 defines each end of the paper dust receiver 94.

As shown in FIG. 13, when the upper frame 110 is mounted to the lower frame 111 with the holder 84 mounted thereon, an upper end of each holder-side partition rib 98 and an upper end of the front wall 101 make contact with the sponge seal 133 which is supported by the ceiling portion 130 of the upper frame 110. Simultaneously, a lower part of the sponge scraper 134, which is supported by the ceiling portion 130, makes contact with the second cleaning roller 83 along the axial direction.

Thus, both ends of the paper dust receiver 94 are sealingly partitioned by the holder-side partition ribs 98 and the ceiling-side partition ribs 135 and the sponge seal 133. The front end of the paper dust receiver 94 is sealingly partitioned by the front wall 101 and the sponge seal 133, and the rear end thereof is sealingly partitioned by the sponge scraper 134, the second cleaning roller 83 and the mid film 105. As a result, a space containing the paper dust receiver 94 is formed as a paper dust reservoir 148 and partitioned off from a roller chamber 149 described below.

As shown in FIG. 13, the upper film 145 is disposed facing the photosensitive drum 28 from above between the first cleaning roller 82 and the scorotron charger 30. The upper film 145 is held at a position where its edge at the free end is slightly away from the photosensitive drum 28. Thus, the first cleaning roller 82 is partitioned off from the photosensitive drum 28 by the lower film 107 at the lower side between the first cleaning roller 82 and the photosensitive drum 28, and partitioned off from the photosensitive drum 28 and the scorotron charger 30 by the upper film 145 at its upper side.

Thus, a space where the first cleaning roller 82 and the second cleaning roller 83 are placed is formed as the roller chamber 149 by the sponge scraper 134, the mid film 105, the lower film 107, and the upper film 145, and is partitioned off from the paper dust reservoir 148 and the photosensitive drum 28.

When the photosensitive drum 28 is driven by a motor (not shown), the power is transmitted to the first cleaning roller 82 via the photosensitive drum driving gear 28*a* and the helical gear 91*a* of the first cleaning roller driving gear 91. The power is further transmitted to the second cleaning roller 83 via the spur gear 91*b* of the first cleaning roller driving gear 91 and the second cleaning roller driving gear 92. Thus, the first and second cleaning rollers 82, 83 rotate in directions indicated by arrows in FIG. 13 along with the photosensitive drum 28. (The first cleaning roller 82 rotates in a clockwise direction, and the second cleaning roller 83 rotates in a counterclockwise direction.)

When toner is transferred onto a sheet 3, a negative bias of which potential is lower than the surface potential of the photosensitive drum 28 is applied to the first cleaning roller 82 via the electrode plate 128*a* and the collar 93*a* so as to attract the toner on the photosensitive drum 28 to the first cleaning roller 82. Then, the toner remaining on the photosensitive drum 28 is temporarily caught by the first cleaning roller 82.

On the other hand, when toner is not transferred to a sheet 3, that is, during a time equal to a time interval from the end of printing of a page to the start of printing of the next page, a positive bias of which is higher than the surface potential of the photosensitive drum 28 is applied to the first cleaning roller 82 via the electrode plate 128*a* and the collar 93*a* so as to attract paper dust on the photosensitive drum 28 toward the first cleaning roller 82. Then, the toner temporarily caught by the first cleaning roller 82 is returned to the photosensitive drum 28, the paper dust adhered from the sheet 3 to the photosensitive drum 28 is caught by the first cleaning roller 82. The toner returned to the photosensitive drum 28 is then collected by the developing roller 34.

Therefore, if an abundance of toner remains on the photosensitive drum 28 after transfer, it is reliably collected by the developing roller 34. Thus, a detrimental effect on image quality due to the remaining toner can be prevented.

To attract only the paper dust on the first cleaning roller 82 toward the second cleaning roller 83, the second cleaning roller 83 is always subjected to a positive bias of which potential is higher than the surface potential of the first cleaning roller 82, via the electrode plate 128*b* and the electrically conductive collar 93*b*.

The paper dust caught by the first cleaning roller 82 is electrically caught by the second cleaning roller 83 whenever it faces the second cleaning roller 83. When the paper dust caught by the second cleaning roller 83 faces the sponge scraper 134, it is scraped by the sponge scraper 134 and stored in the paper dust reservoir 94.

In other words, in the cleaning unit 81, the first cleaning roller 82 electrically attracts the toner and paper dust remaining on the photosensitive drum 28. While the toner attracted to the first cleaning roller 82 is electrically returned to the photosensitive drum 28 and the paper dust attracted to the first cleaning roller 82 is electrically attracted to and caught by the second cleaning roller 83. For this reason, paper dust as well as the remaining toner can be efficiently removed with the cleaner-less developing method, and the ability to remove paper dust can be improved.

Further, as the paper dust caught by the second cleaning roller 83 is stored in the paper dust receiver 94 after it is scraped by the sponge scraper 134, the paper dust is stored without scattering. Thus, the paper dust once eliminated can be prevented from moving again to the photosensitive drum 28, and the ability to remove the paper dust can be improved. In addition, as the paper dust attracted to the second cleaning roller 83 is scraped by the sponge scraper 134, the ability of the second cleaning roller 83 to hold paper dust can be maintained for a long period of time, so that the ability to remove paper dust can be maintained.

The partition walls 96 project from the bottom wall 97 of the paper dust receiver 94, and are spaced with a predetermined distance away from each other. The partition walls 96 partition the paper dust receiver 94 into chambers with a communication through the upper space of the paper dust receiver 94 in the width direction. If the process unit 22 is inclined, paper dust is held in chambers partitioned by the partition walls 96. In this manner, a shift of paper dust in the paper dust receiver 94 can be prevented, thereby reducing the leakage of paper dust from the paper dust receiver 94.

In the process unit 22, the first and second cleaning rollers 82, 83 are supported by the common bearings 85 at both ends, so that their relative positional relationship is maintained constant. Thus, contact pressures of the first and second cleaning rollers 82, 83 are stabilized, and the ability to remove paper dust can be improved with the stable drive.

In the process unit 22, when the upper frame 110 and the lower frame 111 are assembled, the bearings 85 are pinched between the upper frame 110 and the lower frame 111, so that the first cleaning roller 82 and the second cleaning roller 83 are placed in position. With the simple assembly, the first and second cleaning rollers 82, 83 can be placed in position with their relative positional relationship kept constant.

In addition, in the process unit 22, the first cleaning roller 82 is, at the gear-side end, held from above by the first-side upper face 138 of the upper support rib 136 of the upper frame 110 via the first bearing 87, and at the electrode-side end, held from below by the first-side lower face 117 of the lower-side support rib 116 of the lower frame 111. As a result, the first cleaning roller 82 is placed in position horizontally in balance. Thus, the first cleaning roller 82 makes contact with the photosensitive drum 28 uniformly with respect to the axial direction, so that stable drive can be ensured.

When the photosensitive drum 28 is driven, the first cleaning roller 82 is rotated with the engagement between the photosensitive drum driving gear 28*a* and the helical gear 91*a*. In the process unit 22, the photosensitive drum driving gear 28*a* and the helical gear 91*a* rotate upward from the engagement, and the photosensitive drum driving gear 28*a* lifts the helical gear 91*a*. As a result, a lifting force acts on the gear-side end of the first cleaning roller 82.

However, the first bearing 87, disposed at the electrode-side end of the first cleaning roller 82, is pressed from below by the first-side lower face 117, and the first bearing 87, disposed at the gear-side end, is pressed from above by the first-side upper face 138. This structure reliably prevents the gear-side end of the first cleaning roller 83 from being lifted by a force caused by the engagement between the photosensitive drum driving gear 28*a* and the helical gear 91*a*, and allows the first cleaning roller 82 to make contact with the photosensitive drum 28 uniformly with respect to the axial direction. Thus, the photosensitive drum 28 and the first cleaning roller 82 stably rotate.

In the process unit 22, the first and second cleaning rollers 82, 83 are supported in the common bearings 85 at both ends, the bearings 85 are mounted in the holder 84, and the holder 84 is mounted to the holder mounting portion 112 of the lower frame 111. Thereby, the first and second cleaning rollers 82, 83 and the paper dust receiver 94 are united in position in the holder 84 and then mounted to the drum frame 27. Accordingly, handling of the first and second cleaning rollers 82, 83 is simple, and the first and second cleaning rollers 82, 83 are reliably mounted to the drum frame 27 with the simple assembly.

When the first and second cleaning rollers 82, 83 are mounted to the lower frame 111 with this simple assembly, the collars 93*a*, 93*b* make contact with the electrode plates 128*a*, 128*b* provided at the lower frame 111, respectively. Therefore, through contact between the electrode plates 128*a*, 128*b* and the collars 93*a*, 93*b*, the roller shaft 82*a* of the first cleaning roller 82 and the roller shaft 83*a* of the second cleaning roller 83 are subjected to a predetermined bias via the collars 93*a*, 93*b*.

One of advantages of contact between the collars 93*a*, 93*b* and the electrode plates 128*a*, 128*b* is to reduce damage and noise due to friction, as compared with a case when the roller shafts 82*a*, 83*a* of the first and second cleaning rollers 82, 83 are brought in direct contact with the electrode plates 128*a*, 128*b*. Further, the collars 93*a*, 93*b* can be replaced if worn, so that their performance can be maintained.

The electrode plates 128*a*, 128*b* make contact with the circumferential surfaces of the collars 93*a*, 93*b* and not their outside end faces with respect to the axial direction. Even if the first and second cleaning rollers 82, 83 oscillate in the axial direction by a thrust caused by their drive, releasing the contact between the collars 93*a*, 93*b* and the electrode plates 128*a*, 128*b* can be prevented, so that stable power supply can be achieved. As the electrode plates 128*a*, 128*b* make contact with the circumferential surfaces of the collars 93*a*, 93*b*, it saves space on the end portion of each of the first and second cleaning rollers 82, 83 for arranging the electrode plates 128*a*, 128*b*.

In the process unit 22, the torsion coil springs 90 urge the bearings 85. Thereby, the position of the second cleaning roller 83 is kept relative to the first cleaning roller 82, and first cleaning roller 82 is reliably brought in contact with the photosensitive drum 28 with a predetermined pressing force.

The torsion coil springs 90 urge the second cleaning roller 83 downward via the second bearings 88. Thus, the second cleaning roller 83 is reliably mounted to the holder 84 with the position of the second cleaning roller 83 kept relative to the first cleaning roller 82.

When the holder 84 is mounted to the lower frame 111, the first bearings 87 are brought in contact with the corresponding first-side front faces 118, and the first cleaning roller 82 is placed in position with respect to the photosensitive drum 28. Thus, with the simple assembly of the holder 84 and the lower frame 111, the photosensitive drum 28, the first cleaning roller 82, and the second cleaning roller 83 can be simply and reliably placed in position relative to each other.

The bearings 85 are provided with the side films 89 for preventing leakage of paper dust from both ends of the first and second cleaning rollers 82, 83. Even if the first and second cleaning rollers 82, 83 are integrally moved by the urging force of the torsion coil springs 90, the side films 89 prevent leakage of paper dust from both ends of the first and second cleaning rollers 82, 83, thereby preventing dispersion of paper dust removed from the photosensitive drum 28.

In the process unit, the sponge scraper 134 is bought in contact with the second cleaning roller 83 with the simple assembly of the upper frame 110 and the lower frame 111. With this simple assembly, removal of the paper dust by the sponge scraper 134 can be achieved.

The coefficient of friction of the sponge scraper 134 to the second cleaning roller 83 is set smaller than the coefficient of friction of the first cleaning roller 82 to the second cleaning roller 83, thereby reducing the rotational torque of the second cleaning roller 83. In addition, this can prevent slippage between the first cleaning roller 82 and the second cleaning roller 83. The first cleaning roller 82 and the second cleaning roller 83 reliably drive, thereby improving the ability to remove paper dust.

The sponge scraper 134 is formed of a sponge. By widening the sponge area in contact with the second cleaning roller 83, the ability of the sponge scraper 134 to remove paper dust can be improved. The sponge scraper 134 is formed so as to resist being inclined from the contact portion with the second cleaning roller 83 toward the downstream side of the rotational direction of the second cleaning roller 83. More specifically, as shown in FIG. 17A, a length A (width) of the sponge scraper 134, which tangentially extends from the contact portion C between the sponge scraper 134 and the second cleaning roller 83, is set longer than a length B (thickness) of the sponge scraper 134, which extends in an orthogonal direction to the tangential direction. If the sponge scraper 134 makes sliding contact with the second cleaning roller 83, it resists being inclined from the contact portion C with the second cleaning roller 83 toward the downstream side of the rotational direction of the second cleaning roller 83. As a result, the scraping performance of the sponge scraper 134 is maintained over the long run. The sponge scraper 134 is resistant to deformation, so that increase in rotational torque of the second cleaning roller 83 can be prevented.

Figure 17B:
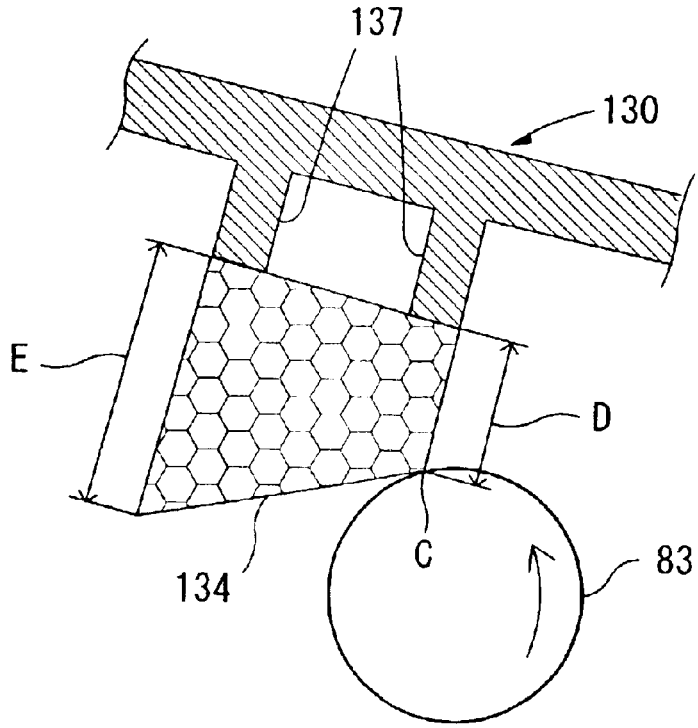

To make the sponge scraper 134 resist from being inclined from the contact portion C with the second cleaning roller 83 toward the downstream side of the rotational direction of the second cleaning roller 83, the sponge scraper 134 may be shaped as shown in FIG. 17B. In FIG. 17B, thickness D of the sponge scraper 134, which is at an upstream side of the rotational direction of the second cleaning roller 83, is thinner than thickness E thereof, which is at a downstream side of the rotational direction of the second cleaning roller 83, with respect to the contact portion C between the sponge scraper 134 and the second cleaning roller 83. Even when shaped in this manner, the sponge scraper 134 can resist being inclined from the contact portion C toward the downstream side of the rotational direction of the second cleaning roller 83.

In the process unit 22, the photosensitive drum 28 and the first cleaning roller 82 are coupled via the photosensitive drum driving gear 28*a* and the first cleaning roller driving gear 91, which are helical gears. Thus, driving force from the motion of the photosensitive drum 28 is stably transmitted to the first cleaning roller 82 via the helical gears. For this reason, the motion of the first cleaning roller 82 can be stabilized.

When the photosensitive drum 28 and the first cleaning roller 82 are coupled via the helical gears, a thrust force acts on the first cleaning roller driving gear 91. The slide plate 129 is disposed opposite to the first cleaning roller driving gear 91, and the projecting portion 91*c* of the first cleaning roller driving gear 91 slides on the slide plate 129. When the slide plate 129 and the projecting portion 91*c* are in contact with each other, the slide plate 129 receives a pressing force of the first cleaning roller driving gear 91 caused by the thrust force. Thus, increase in rotational torque of the first cleaning roller 82 and damage to the lower frame 111 formed of a resin can be prevented. In addition, the projecting portion 91*c* makes contact with the slide plate 129, thus assuring reduction of the sliding resistance between the first cleaning roller driving gear 91 and the slide plate 129.

As the first cleaning roller 82 and the second cleaning roller 83 are coupled with the engagement between the first cleaning roller driving gear 91 and the spur gear 91*b*, the second cleaning roller 83 is reliably driven against the first cleaning roller 82. In addition, the first cleaning roller 82 and the second cleaning roller 83 are rotated with substantially a 1:1 circumferential speed ratio. Consequently, the second cleaning roller 83 can be stably driven against the first cleaning roller 82 with a small driving force.

The roller portion 83*b* of the second cleaning roller 83 is formed with an axial length greater than or equal to that of the roller portion 82*b* of the first cleaning roller 82. If the axial length of the roller portion 82*b* of the first cleaning roller 82 is longer than that of the roller portion 83*b* of the second cleaning roller 83, a pressing force applied to the photosensitive drum 28 varies between the contact portion and the non-contact portion between the first cleaning roller 82 and the second cleaning roller 83, so that a pressing force of the first cleaning roller 82 against the photosensitive drum 28 becomes uneven in the axial direction.

As long as the axial length of the roller portion 83*b* of the second cleaning roller 83 is set longer than that of the roller portion 82*b* of the first cleaning roller 82 as indicated in this embodiment, the roller portion 82*b* of the first cleaning roller 82 can make a surface-to-surface contact with the second cleaning roller 83 across the length. Thus, the pressing force of the first cleaning roller 82 against the photosensitive drum 28 becomes uniform, so that the first cleaning roller 82 can be pressed against the photosensitive drum 28 uniformly with respect to the axial direction.

In the process unit 22, the paper dust receiver 94 is separated from the first cleaning roller 82 by the mid film 105, which makes contact with the second cleaning roller 83 at the lower part thereof. The mid film 105 prevents paper dust deposited on the paper dust receiver 94 from moving to the first cleaning roller 82 from the lower part of the second cleaning roller 83. Thus, the paper dust once removed from the first cleaning roller 82 never again adheres to the first cleaning roller 82, thereby improving the ability to remove paper dust.

In the process unit 22, the holder-side partition ribs 98 and the ceiling-side partition ribs 135 overlap each other at each end of the paper dust receiver 94 to form the overlap portion 147, thereby the ends of the paper dust receiver 94 are defined. Thus, the ends of the paper dust receiver 94 can be defined without providing any special member. As the holder-side partition ribs 98 and the ceiling-side partition ribs 135 overlap each other at both ends of the paper dust receiver 94 in the width direction, the leakage of paper dust from both ends can be reliably reduced.

The upper end of the front wall 101 of the paper dust receiver 94 is in contact with the sponge seal 133 supported by the ceiling portion 130 of the upper frame 110. Thereby the leakage of paper dust from the front wall 101 of the paper dust receiver 94 can be reliably reduced with the simple assembly of the upper frame 110 and the lower frame 111.

The bottom of the sponge scraper 134, which is supported by the ceiling portion 130 of the upper frame 110, makes contact with the second cleaning roller 83 along the axial direction. Thereby, with the simple assembly of the upper frame 110 and the lower frame 111, both ends of the paper dust receiver 94 are sealingly partitioned by the holder-side partition ribs 98, the ceiling-side partition ribs 135, and the sponge seal 133. The front end of the paper dust receiver 94 is sealingly partitioned by the front wall 101 and the sponge seal 133, and the rear end of the paper dust receiver 94 is sealingly partitioned by the sponge scraper 134, the second cleaning roller 83, and the mid film 105.

As a result, a space containing the paper dust receiver 94 is formed as the paper dust reservoir 148 and partitioned off from the roller chamber 149 where the first and second cleaning rollers 82, 83 are provided.

Only with the simple assembly of the upper frame 110 and the lower frame 111, the paper dust receiver 94 can be separated from the first cleaning roller 82, so that the paper dust stored in the paper dust receiver 94 can be prevented from dispersing and moving again to the first cleaning roller 82.

In the process unit 22, the first cleaning roller 82 is partitioned off from the photosensitive drum 28 by the lower film 107 at the lower part between the first cleaning roller 82 and the photosensitive drum 28, and by the upper film 145 at the upper part. The lower film 107 and the upper film 145 can prevent paper dust deposited on the first cleaning roller 82 from moving to the photosensitive drum 28. Thus, the paper dust once removed from the first cleaning roller 82 never again adheres to the first cleaning roller 82, thereby improving the ability to remove paper dust.

The free end of the lower film 107 faces toward the downstream side of the rotational direction of the photosensitive drum 28 and makes contact with the photosensitive drum 28 across the axial length thereof. The free end of the upper film 145 is slightly away from the photosensitive drum 28 across the axial length thereof. This structure ensures smooth rotation of the photosensitive drum 28, reduction of damage to the surface of the photosensitive drum 28, and separation between the first cleaning roller 82 and the photosensitive drum 28 by the lower film 107 and the upper film 145. Thus, leakage of paper dust from the first cleaning roller 82 to the photosensitive drum 28 can be favorably prevented.

The upper film 145 is disposed between the first cleaning roller 82 and the scorotron charger 30. The upper film 145 prevents the paper dust deposited on the first cleaning roller 82 from moving to the grid electrode 30*a* of the scorotron charger 30. Thus, the photosensitive drum 28 can be favorably charged. The lower film 107 and the upper film 145 have a longitudinal length equal to or greater than the roller portion 82*b* of the first cleaning roller 82. This prevents further leakage of paper dust from the first cleaning roller 82 to the photosensitive drum 28. As a result, the roller chamber 149 is defined by the sponge scraper 134, the mid film 105, the lower film 107, and the upper film 145, and partitioned off from the paper dust reservoir 148 and the photosensitive drum 28. Thus, the paper dust collected in the paper dust reservoir 148 can be prevented from moving to the roller chamber 149, and paper dust to be attracted to the first and second cleaning rollers 82, 83 in the roller chamber 149 can be prevented from moving to the photosensitive drum 28. Accordingly, dispersion of the paper dust can be prevented in each compartment, thereby improving the ability to remove paper dust. The laser printer 1, which is equipped with such a process unit 22, achieves the improvement of the ability to remove paper dust and thereby provides high-quality image formation.

While the invention has been described in detail and with reference to the specific embodiments thereof, it would be apparent to those skilled in the art that various changes, arrangements and modifications may be applied therein without departing from the spirit and scope of the invention.

What is claimed is:

1. A process unit, comprising:

an image holding member that holds an image thereon;

a first cleaning roller that contacts a surface of the image holding member;

a second cleaning roller that contacts a surface of the first cleaning roller; and a bearing member that integrally forms a first bearing and a second bearing on a base element, the first bearing supporting the first cleaning roller rotatably and the second bearing supporting the second cleaning roller rotatably.

2. The process unit according to claim 1, further comprising:

an urging element, provided at the bearing member, that urges the first cleaning roller toward the image holding member and the second cleaning roller toward the first cleaning roller.

3. The process unit according to claim 1, wherein a length of the second cleaning roller is greater than or equal to a length of the first cleaning roller.

4. The process unit according to claim 1, wherein a length of the first cleaning roller is greater than or equal to a length of an image formation area of the image holding member.

5. The process unit according to claim 1, further comprising:

a housing formed with an upper frame and a lower frame joined with the upper frame, the bearing member being positioned when the upper frame and the lower frame are joined.

6. The process unit according to claim 5, wherein two bearing members, a first bearing member and a second bearing member, support a respective end of the first cleaning roller and the second cleaning roller, with the first bearing member supported at the upper frame and the second bearing member supported at the lower frame.

7. The process unit according to claim 6, wherein the housing further comprises:

a first rib portion that contacts the first bearing member; and a second rib portion that contacts the second bearing member.

8. The process unit according to claim 6, further comprising:

a first sealing element provided at the first bearing member and the second bearing member, the first sealing element preventing foreign matter from leaking out at both ends of the first cleaning roller and the second cleaning roller.

9. The process unit according to claim 5, further comprising:

a holder that supports the bearing member, with the holder supported at the housing.

10. The process unit according to claim 5, wherein the first cleaning roller is formed with a foam material around a steel shaft.

11. The process unit according to claim 10, wherein the second cleaning roller is a steel shaft with gilt thereon.

12. The process unit according to claim 11, wherein a collar is attached at an end of the steel shaft of the first cleaning roller, with the collar being electrically conductive.

13. The process unit according to claim 12, wherein a collar is attached at an end of the steel shaft of the second cleaning roller, the collar being electrically conductive.

14. The process unit according to claim 13, further comprising;

a first electrode plate and a second electrode plate provided at the housing, wherein the collar of the first cleaning roller contacts the first electrode plate, and the collar of the second cleaning roller contacts the second electrode plate.

15. The process unit according to claim 5, further comprising:

a scraper that removes foreign matter from the second cleaning roller; and a container that holds the foreign matter removed from the second cleaning roller.

16. The process unit according to claim 15, wherein the scraper is provided at the upper frame, with the scraper contacting a surface of the second cleaning roller when the upper frame joins the lower frame.

17. The process unit according to claim 16, wherein a friction coefficient between the scraper and the second cleaning roller is smaller than a friction coefficient between the first cleaning roller and the second cleaning roller.

18. The process unit according to claim 15, wherein the scraper is formed so as to resist being inclined from a contact portion with the second cleaning roller toward a downstream side of a rotational direction of the second cleaning roller.

19. The process unit according to claim 18, wherein a length of the scraper, which tangentially extends from the contact portion between the scraper and the second cleaning roller, is longer than a length of the scraper, which extends in an orthogonal direction to the tangential direction.

20. The process unit according to claim 18, wherein a thickness of the scraper, which is at an upstream side of the rotational direction of the second cleaning roller, is thinner than a thickness thereof which is at a downstream side of the rotational direction of the second cleaning roller, with respect to the contact portion.

21. The process unit according to claim 5, wherein the image holding member has an end with a first helical gear, and the first cleaning roller has an end with a second helical gear that engages the first helical gear.

22. The process unit according to claim 21, further comprising:

a metal plate provided at the housing that contacts an end of the second helical gear.

23. The process unit according to claim 22, further comprising:

a gear train that communicates a rotation of the first cleaning roller with the second cleaning roller.

24. The process unit according to claim 23, wherein a peripheral speed of the first cleaning roller is substantially equal to a peripheral speed of the second cleaning roller.

25. An image forming apparatus, comprising:

the process unit according to claim 1, wherein the process unit further comprises:

a developing device that provides a developing agent to the image holding member; and a transfer device that transfer the developing agent from the image holding member to a recording medium.

26. The image forming apparatus according to claim 25, further comprising:

a first biasing device that applies a first bias to the first cleaning roller such that the developing agent and paper dust are transferred from the image holding member to the first cleaning roller; and a second biasing device that applies a second bias to the second cleaning roller such that the paper dust is transferred from the first cleaning roller to the second cleaning roller.

27. The image forming apparatus according to claim 26, wherein the first biasing device changes the first bias such that the developing agent is transferred from the first cleaning roller to the image holding member.

28. A process unit, comprising:

a housing;

an image holding member provided at the housing;

a first cleaning roller that contacts a surface of the image holding member; and a second cleaning roller that contacts a surface of the first cleaning roller, wherein the housing is formed with an upper frame and a lower frame joined with the upper frame, and the first cleaning roller and the second cleaning roller are positioned when the upper frame and the lower frame are joined.

29. The process unit according to claim 28, further comprising:

a holder that supports the first cleaning roller and the second cleaning roller, with the holder being supported at the housing.

30. The process unit according to claim 28, wherein a collar is attached at an end of the first cleaning roller, with the collar being electrically conductive.

31. The process unit according to claim 30, wherein a collar is attached at an end of the second cleaning roller, with the collar being electrically conductive.

32. The process unit according to claim 31, further comprising;

a first electrode plate and a second electrode plate provided at the housing, wherein the collar of the first cleaning roller contacts the first electrode plate, and the collar of the second cleaning roller contacts the second electrode plate.

33. The process unit according to claim 28, further comprising:

a scraper that removes foreign matter from the second cleaning roller; and a container that holds the foreign matter removed from the second cleaning roller.

34. The process unit according to claim 33, wherein the scraper is provided at the upper frame, with the scraper contacting a surface of the second cleaning roller when the upper frame joins the lower frame.

35. The process unit according to claim 34, wherein a friction coefficient between the scraper and the second cleaning roller is smaller than a friction coefficient between the first cleaning roller and the second cleaning roller.

36. The process unit according to claim 33, wherein the scraper is formed so as to resist being inclined from a contact portion with the second cleaning roller toward a downstream side of a rotational direction of the second cleaning roller.

37. The process unit according to claim 36, wherein a length of the scraper, which tangentially extends from the contact portion between the scraper and the second cleaning roller, is longer than a length of the scraper, which extends in an orthogonal direction to the tangential direction.

38. The process unit according to claim 36, wherein a thickness of the scraper, which is at an upstream side of the rotational direction of the second cleaning roller, is thinner than a thickness thereof which is at a downstream side of the rotational direction of the second cleaning roller, with respect to the contact portion.

39. A process unit, comprising:

a housing;

an image holding member provided at the housing;

a cleaning roller that contacts a surface of the image holding member; and a first bearing member and a second bearing member each supported by the housing, the first bearing member supporting a first end of the cleaning roller rotatably, and the second bearing member supporting a second end of the cleaning roller rotatably, wherein the first bearing member is positioned by the housing in one direction and the second bearing member is positioned by the housing in an opposite direction to the one direction.

40. A process unit, comprising:

a housing:

an image holding member, supported in the housing, that holds an image on a surface thereof, the image holding member having an end with a first helical gear; and a cleaning roller that contacts the surface of the image holding member, the cleaning roller having an end with a second helical gear that engages the first helical gear.

41. The process unit according to claim 40, further comprising:

a metal plate provided at the housing that contacts an end of the second helical gear.

42. A process unit, comprising:

a housing;

an image holding member, supported in the housing, that holds an image on a surface thereof;

a first cleaning roller that contacts the surface of the image holding member and that holds foreign matter from the image holding member;

a second cleaning roller that contacts a surface of the first cleaning roller and that holds the foreign matter from the first cleaning roller;

a scraper that contacts a surface of the second cleaning roller and removes the foreign matter from the second cleaning roller;

a container that holds the foreign matter removed from the second cleaning roller; and a holder that supports the first cleaning roller and the second cleaning roller, the holder being supported at the housing, wherein the container is provided at the holder.

43. The process unit according to claim 40, wherein the container is positioned about the second cleaning roller opposite to the first cleaning roller.

44. The process unit according to claim 40, further comprising:

a plurality of partition plates, each standing from a bottom wall along a direction orthogonal to a width of the container, that provides a communication through an upper space of the container.

45. The process unit according to claim 40, further comprising:

a first bearing member and a second bearing member supported by the holder, both of the first bearing member and the second bearing member integrally forming a first bearing and a second bearing on a base element, the first bearing supporting the first cleaning roller rotatably and the second bearing supporting the second cleaning roller rotatably.

46. The process unit according to claim 45, further comprising:

a first sealing element provided at the first bearing member and the second bearing member, the first sealing element preventing foreign matter from leaking out at both ends of the first cleaning roller and the second cleaning roller.

47. The process unit according to claim 45, further comprising:

a first sealing element that contacts a surface of the second cleaning roller and forms the container separated from the first cleaning roller.

48. The process unit according to claim 47, wherein the housing is formed with an upper frame and a lower frame joined with the upper frame, the holder being supported at the lower frame, wherein the container is formed when the upper frame is joined with the lower frame.

49. The process unit according to claim 48, wherein the scraper is provided at the upper frame, with the scraper contacting the surface of the second cleaning roller when the upper frame is joined with the lower frame.

50. The process unit according to claim 48, further comprising:

a holder rib projecting from both ends of the holder; and an upper rib projecting from both ends of the upper frame, wherein the holder rib and the upper rib overlap when the upper frame is joined with the lower frame.

51. The process unit according to claim 48, further comprising:

a second sealing element, provided at the upper frame, that contacts a front wall of the container when the upper frame is joined with the lower frame.

52. The process unit according to claim 48, further comprising:

a second sealing element, provided along an axial direction of the image holding member, that contacts the image holding member such that a free end of the second sealing element faces downstream of a rotational direction of the image holding member, wherein a length of the second sealing element is equal to or longer than a length of the first cleaning roller.

53. The process unit according to claim 48, further comprising:

a second sealing element provided facing the image holding member adjacent to the first cleaning roller such that a free end of the second sealing element is away from the image holding member, wherein a length of the second sealing element is equal to or longer than a length of the first cleaning roller.

54. The process unit according to claim 40, wherein the container forms a roller chamber that accommodates the first cleaning roller and the second cleaning roller.

55. The process unit according to claim 40, wherein the first cleaning roller is formed with a foam material around a steel shaft.

56. The process unit according to claim 40, wherein the second cleaning roller is a steel shaft with gilt thereon.

57. An image forming apparatus, comprising:

the process unit according to claim 40, wherein the process unit further comprises:

a developing device that provides a developing agent to the image holding member; and a transfer device that transfer the developing agent from the image holding member to a recording medium.

58. The image forming apparatus according to claim 57, further comprising:

a first biasing device that applies a first bias to the first cleaning roller such that the developing agent and paper dust are transferred from the image holding member to the first cleaning roller; and a second biasing device that applies a second bias to the second cleaning roller such that the paper dust is transferred from the first cleaning roller to the second cleaning roller.

59. The image forming apparatus according to claim 58, wherein the first biasing device changes the first bias such that the developing agent is transferred from the first cleaning roller to the image holding member.

60. The process unit according to claim 40, wherein the container is formed with a bottom wall and a plurality of projection walls projecting from the bottom wall, wherein the plurality of projection walls form a plurality of storage chambers and a common space above the plurality of the storage chambers.

* * * * *